US006818601B1

(12) United States Patent
Lange

(10) Patent No.: US 6,818,601 B1
(45) Date of Patent: Nov. 16, 2004

(54) DISPERSANT-VISCOSITY IMPROVERS FOR LUBRICATING OIL COMPOSITIONS

(75) Inventor: Richard M. Lange, Euclid, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 563 days.

(21) Appl. No.: 09/599,709

(22) Filed: Jun. 22, 2000

Related U.S. Application Data

(63) Continuation of application No. 08/713,704, filed on Sep. 13, 1996, now abandoned.

(51) Int. Cl.[7] ..... C10M 145/00; C10M 149/00

(52) U.S. Cl. ..... 508/240; 508/507; 508/508; 525/64; 525/92; 525/381; 525/382

(58) Field of Search ..... 508/221, 235, 508/240, 507, 508; 525/64, 92, 381, 382

(56) References Cited

U.S. PATENT DOCUMENTS

| | | | | |
|---|---|---|---|---|
| 4,077,893 | A | 3/1978 | Kiovsky | 252/56 R |
| 4,169,063 | A | 9/1979 | Kiovsky | 252/51.5 A |
| 4,517,104 | A | 5/1985 | Bloch et al. | 252/51.5 A |
| 4,632,769 | A | 12/1986 | Gutierrez et al. | 252/48.6 |
| 4,670,173 | A | 6/1987 | Hayashi et al. | 252/51.5 A |
| 4,735,736 | A | 4/1988 | Chung | 252/48.6 |
| 4,803,003 | A | 2/1989 | Chung | 252/51.5 A |
| 5,035,821 | A | 7/1991 | Chung et al. | 252/51.5 A |
| 5,049,294 | A | 9/1991 | Van Zon et al. | 252/51.5 A |
| 5,160,648 | A | 11/1992 | Steckel | 252/47.5 |
| 5,210,146 | A | 5/1993 | Gutierrez et al. | 252/301 |
| 5,512,192 | A | 4/1996 | Lange et al. | 252/51.5 A |
| 5,540,851 | A | 7/1996 | Lange | 508/194 |
| 6,486,101 | B2 * | 11/2002 | Luciani et al. | 508/232 |
| 6,492,306 | B2 * | 12/2002 | Sivik et al. | 508/232 |

FOREIGN PATENT DOCUMENTS

| | | | |
|---|---|---|---|
| EP | 0352070 | 10/1992 | C10M/143/02 |
| EP | 0682102 | 11/1995 | C10M/159/12 |
| WO | 96/01854 | 1/1996 | C10M/159/12 |

OTHER PUBLICATIONS

Ranney, M.W., "Lubricant Additives", Noyes Data Corp. (1973) pp. 119–136.

Ranney, M.W., "Lubricant Additives, Recent Developments", Noyes Data Corp. (1978), pp. 151–159.

Ranney, M.W., "Synthetic Oils and Additives for Lubricants, Advances Since 1977", Noyes Data Corp. (1980), pp. 119–150.

* cited by examiner

*Primary Examiner*—Cephia D. Toomer
(74) *Attorney, Agent, or Firm*—David M. Shold; Michael F. Esposito

(57) ABSTRACT

A composition of matter suitable for use as a dispersant-viscosity improver for lubricating oil compositions comprises the reaction product of reactants comprising (a) hydrocarbon polymer grafted with an α,β-ethylenically unsaturated carboxylic acid or functional derivative thereof; and (b) an amine selected from the group consisting of (b-1) a product made by contacting at least one hydroxy-containing material with at least one amine having at least one N—H group, and (b-2) an acylated derivative of (b-1) containing at least one condensable N—H group.

41 Claims, No Drawings

DISPERSANT-VISCOSITY IMPROVERS FOR LUBRICATING OIL COMPOSITIONS

This application is a continuation of U.S. patent application Ser. No. 08/713,704 filed Sep. 13, 1996 now abandoned.

FIELD OF THE INVENTION

This invention relates to dispersant-viscosity improvers for lubricating oils, and oil compositions and concentrates containing such dispersant-viscosity improvers.

BACKGROUND OF THE INVENTION

The viscosity of lubricating oils, particularly the viscosity of mineral oil based lubricating oils, is generally dependent upon temperature. As the temperature of the oil is increased, the viscosity usually decreases.

The function of a viscosity improver is to reduce the extent of the decrease in viscosity as the temperature is raised or to reduce the extent of the increase in viscosity as the temperature is lowered, or both. Thus, a viscosity improver ameliorates the change of viscosity of an oil containing it with changes in temperature. The fluidity characteristics of the oil are improved.

Viscosity improvers are usually polymeric materials and are often referred to as viscosity index improvers.

Dispersants are also well-known in the lubricating art. Dispersants are employed in lubricants to keep impurities, particularly those formed during operation of mechanical devices such as internal combustion engines, automatic transmissions, etc. in suspension rather than allowing them to deposit as sludge or other deposits on the surfaces of lubricated parts.

Multifunctional additives that provide both viscosity improving properties and dispersant properties are likewise known in the art. Such products are described in numerous publications including Dieter Klamann, "Lubricants and Related Products", Verlag Chemie Gmbh (1984), pp 185–193; C. V. Smalheer and R. K. Smith "Lubricant Additives", Lezius-Hiles Co. (1967); M. W. Ranney, "Lubricant Additives", Noyes Data Corp. (1973), pp 92–145, M. W. Ranney, "Lubricant Additives, Recent Developments", Noyes Data Corp. (1978), pp 139–164; and M. W. Ranney, "Synthetic Oils and Additives for Lubricants", Noyes Data Corp. (1980), pp 96–166. Each of these publications is hereby expressly incorporated herein by reference.

Dispersant-viscosity improvers are generally prepared by functionalizing, i.e., adding polar groups, to a hydrocarbon polymer backbone.

Hayashi, et al, U.S. Pat. No. 4,670,173 relates to compositions suitable for use as dispersant-viscosity improvers made by reacting an acylating reaction product which is formed by reacting a hydrogenated block copolymer and an alpha-beta olefinically unsaturated reagent in the presence of free-radical initiators, then reacting the acylating product with a primary amine and optionally with a polyamine and a mono-functional acid.

Chung et al, U.S. Pat. No. 5,035,821 relates to viscosity index improver-dispersants comprised of the reaction products of an ethylene copolymer grafted with ethylenically unsaturated carboxylic acid moieties, a polyamine having two or more primary amino groups or polyol and a high functionality long chain hydrocarbyl substituted dicarboxylic acid or anhydride.

Van Zon et al, U.S. Pat. No. 5,049,294, relates to dispersant/VI improvers produced by reacting an a alpha-beta unsaturated carboxylic acid with a selectively hydrogenated star-shaped polymer then reacting the product so formed with a long chain alkane-substituted carboxylic acid and with a $C_1$ to $C_{18}$ amine containing 1 to 8 nitrogen atoms and/or with an alkane polyol having at least two hydroxy groups or with the preformed product thereof.

Bloch et al, U.S. Pat. No. 4,517,104, relates to oil soluble viscosity improving ethylene copolymers reacted or grafted with ethylenically unsaturated carboxylic acid moieties then with polyamines having two or more primary amine groups and a carboxylic acid component or the preformed reaction product thereof.

Gutierrez et al, U.S. Pat. No. 4,632,769, describes oil-soluble viscosity improving ethylene copolymers reacted or grafted with ethylenically unsaturated carboxylic acid moieties and reacted with polyamines having two or more primary amine groups and a $C_{22}$ to $C_{28}$ olefin carboxylic acid component.

Steckel, U.S. Pat. No. 5,160,648 describes dispersant materials prepared by reacting highly condensed polyamines with carboxylic reactants and phenolic reactants.

Each of these patents is hereby expressly incorporated herein by reference.

For additional disclosures concerning multi-purpose additives and particularly viscosity improvers and dispersants, the disclosures of the following United States patents are incorporated herein by reference:

| | | |
|---|---|---|
| 2,973,344 | 3,488,049 | 3,799,877 |
| 3,278,550 | 3,513,095 | 3,842,010 |
| 3,311,558 | 3,563,960 | 3,864,098 |
| 3,312,619 | 3,598,738 | 3,864,268 |
| 3,326,804 | 3,615,288 | 3,879,304 |
| 3,403,011 | 3,637,610 | 4,033,889 |
| 3,404,091 | 3,652,239 | 4,051,048 |
| 3,445,389 | 3,687,849 | 4,234,435 |

It is a primary object of this invention to provide novel multi-purpose lubricant additives.

A more specific object is to provide multi-purpose additives directed to improving lubricant viscosities and dispersancy properties.

A further object is to provide processes for preparing such multi-purpose additives.

Still another object is to provide lubricants having improved dispersancy and viscosity properties.

Other objects will in part be obvious in view of this disclosure and will in part appear hereinafter.

SUMMARY OF THE INVENTION

The present invention is directed to a dispersant-viscosity improver for lubricating oil compositions comprising the reaction product of reactants comprising (a) a hydrocarbon polymer grafted with an α,β-ethylenically unsaturated carboxylic acid or functional derivative thereof; and (b) an amine selected from the group consisting of (b-1) a polyamine product having at least one condensable primary or secondary amino group, made by contacting at least one hydroxy-containing material (b-i) having the general formula $$(R)_nY_z—X_p—(A(OH)_q)_m \quad (I)$$

wherein each R is independently H or a hydrocarbon based group, Y is selected from the group consisting of O, N, and S, X is a polyvalent hydrocarbon based group, A is a polyvalent hydrocarbon based group, n is 1 or 2, z is 0 or 1, p is 0 or 1, q ranges from 1 to about 10, and m is a number ranging from 1 to about 10; with (b-ii) at least one amine having at least one N—H group, and (b-2) an acylated derivative of (b-1) containing at least one condensable N—H group, and optionally, (c) at least one hydrocarbon group substituted carboxylic acid or anhydride, and optionally, (d) at least one preformed polyester containing at least one condensable hydroxyl group.

DETAILED DESCRIPTION OF THE PREFERRED EMBODIMENTS

According to the present invention, a composition of matter suitable for use as a dispersant-viscosity improver for lubricating oil compositions is the reaction product of a hydrocarbon polymer grafted with an α,β-ethylenically unsaturated carboxylic acid or functional derivative thereof; and an amine selected from the group consisting of (b-1) a polyamine product having at least one condensable primary or secondary amino group, made by contacting at least one hydroxy-containing material (b-i) having the general formula $$(R)_nY_z—X_p—(A(OH)_q)_m \quad (I)$$

wherein each R is independently H or hydrocarbon based group, Y is selected from the group consisting of O, N and S, X is a polyvalent hydrocarbon based group, A is a polyvalent hydrocarbon based group, n is 1 or 2, z is 0 or 1, p is 0 or 1, q ranges from 1 to about 10, and m is a number ranging from 1 to about 10; with (b-ii) at least one amine having at least one N—H group, and an acylated derivative of (b-1) containing at least one condensable N—H group, and optionally, as a solubilizing agent when the amine (b) is (b-1), at least one hydrocarbon group substituted carboxylic acid or anhydride.

As used herein, the terms "hydrocarbon", "hydrocarbyl" or "hydrocarbon based" mean that the group being described has predominantly hydrocarbon character within the context of this invention. These include groups that are purely hydrocarbon in nature, that is, they contain only carbon and hydrogen. They may also include groups containing substituents or atoms which do not alter the predominantly hydrocarbon character of the group. Such substituents may include halo-, alkoxy-, nitro-, etc. These groups also may contain hetero atoms. Suitable hetero atoms will be apparent to those skilled in the art and include, for example, sulfur, nitrogen and oxygen. Therefore, while remaining predominantly hydrocarbon in character within the context of this invention, these groups may contain atoms other than carbon present in a chain or ring otherwise composed of carbon atoms.

In general, no more than about three non-hydrocarbon substituents or hetero atoms, and preferably no more than one, will be present for every 10 carbon atoms in the hydrocarbon or hydrocarbon based groups. Most preferably, the groups are purely hydrocarbon in nature, that is they are essentially free of atoms other than carbon and hydrogen.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated, in a lubricating oil composition. For a further discussion of the terms oil soluble and dispersible, particularly "stably dispersible", see U.S. Pat. No. 4,320,019 which is expressly incorporated herein by reference for relevant teachings in this regard.

Reactant (a) employed in preparing dispersant-viscosity improvers of this invention is a hydrocarbon polymer grafted with an ethylenically unsaturated carboxylic acid or functional derivative thereof.

Examples of grafted polymers (a) employed in this invention are provided hereinafter.

The Hydrocarbon Polymer

As used herein, the expression 'polymer' refers to polymers of all types, i.e., homopolymers and copolymers. The term homopolymer refers to polymers derived from essentially one monomeric species; copolymers are defined herein as being derived from 2 or more monomeric species.

The hydrocarbon polymer is an essentially hydrocarbon based polymer, usually one having a number average molecular weight ($\overline{M}_n$) between 20,000 and 500,000. Molecular weights of the polymeric hydrocarbon polymer are determined using well known methods described in the literature. Examples of procedures for determining the molecular weights are gel permeation chromatography (GPC) (also known as size-exclusion chromatography) and vapor phase osmometry (VPO). These and other procedures are described in numerous publications including:

P. J. Flory, "Principles of Polymer Chemistry", Cornell University Press (1953), Chapter VII, pp 266–316, and "Macromolecules, an Introduction to Polymer Science", F. A. Bovey and F. H. Winslow, Editors, Academic Press (1979), pp 296–312.

W. W. Yau, J. J. Kirkland and D. D. Bly, "Modern Size Exclusion Liquid Chromatography", John Wiley and Sons, New York, 1979.

A measurement which is complementary to a polymer's molecular weight is the melt index (ASTM D-1238). Polymers of high melt index generally have low molecular weight, and vice versa. The grafted polymers of the present invention preferably have a melt index of up to 20 dg/min, more preferably 0.1 to 10 dg/min.

These publications are hereby incorporated by reference for relevant disclosures contained therein relating to the determination of molecular weight.

When the molecular weight of a polymer is greater than desired, it may be reduced by techniques known in the art. Such techniques include mechanical shearing of the polymer employing masticators, ball mills, roll mills, extruders and the like. Oxidative or thermal shearing or degrading techniques are also useful and are known. Details of numerous procedures for shearing polymers are given in U.S. Pat. No. 5,348,673 which is hereby incorporated herein by reference for relevant disclosures in this regard.

The polymer may contain aliphatic, aromatic or cycloaliphatic components, or mixtures thereof. The hydrocarbon polymer is often hydrogenated to such an extent that the resulting hydrogenated polymer has olefinic unsaturation, based on the total number of carbon to carbon bonds in the polymer, of less than 5%. Preferably, the hydrogenated polymer will contain less than 2%, more preferably no more than 1% residual unsaturation. Most preferably, the hydrocarbon polymer is exhaustively hydrogenated. Aromatic unsaturation is not considered olefinic unsaturation within the context of this invention. Depending on hydrogenation conditions, up to about 50% of aromatic groups may be hydrogenated.

In preferred embodiments, the hydrocarbon polymer is an oil soluble or dispersible homopolymer or copolymer selected from the group consisting of:

(1) hydrogenated polymers of dienes;

(2) hydrogenated copolymers of conjugated dienes with vinyl substituted aromatic compounds;

(3) polymers of alpha-olefins having from 2 to about 28 carbon atoms;

(4) olefin-diene copolymers; and (5) star polymers.

These preferred polymers are described in greater detail hereinbelow.

(1) Hydrogenated Polymers of Dienes

The hydrocarbon polymer may be a hydrogenated homopolymer or copolymer of one or more dienes. The dienes may be conjugated such as isoprene, butadiene and piperylene or non-conjugated such as 1–4 hexadiene and dicyclopentadiene. Polymers of conjugated dienes are preferred. Such polymers are conveniently prepared via free radical and anionic polymerization techniques. Emulsion techniques are commonly employed for free radical polymerization.

Hydrogenation is usually accomplished employing catalytic methods. Catalytic techniques employing hydrogen under high pressure and at elevated temperature are well-known to those skilled in the chemical art.

An extensive discussion of hydrogenated diene polymers appears in the "Encyclopedia of Polymer Science and Engineering", Volume 2, pp 550–586 and Volume 8, pp 499–532, Wiley-Interscience (1986), which is hereby expressly incorporated herein by reference for relevant disclosures in this regard.

Hydrogenated polymers include homopolymers and copolymers of conjugated dienes including polymers of 1,3-dienes of the formula

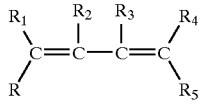

wherein each substituent denoted by R, or R with a numerical subscript, is independently hydrogen or hydrocarbon based, wherein hydrocarbon based is as defined hereinabove. Preferably at least one substituent is H. Normally, the total carbon content of the diene will not exceed 20 carbons. Preferred dienes for preparation of the polymer are piperylene, isoprene, 2,3-dimethyl-1,3-butadiene, chloroprene and 1,3-butadiene.

Suitable homopolymers of conjugated dienes are described, and methods for their preparation are given in numerous U.S. patents, including the following:

U.S. Pat. No. 3,547,821

U.S. Pat. No. 3,835,053

U.S. Pat. No. 3,959,161

U.S. Pat. No. 3,965,019

U.S. Pat. No. 4,085,055

U.S. Pat. No. 4,116,917

As a specific example, U.S. Pat. No. 3,959,161 teaches the preparation of hydrogenated polybutadiene. In another example, upon hydrogenation, 1,4-polyisoprene becomes an alternating copolymer of ethylene and propylene.

Copolymers of conjugated dienes are prepared from two or more conjugated dienes. Useful dienes are the same as those described in the preparation of homopolymers of conjugated dienes hereinabove. The following U.S. Patents describe diene copolymers and methods for preparing them:

U.S. Pat. No. 3,965,019

U.S. Pat. No. 4,073,737

U.S. Pat. No. 4,085,055

U.S. Pat. No. 4,116,917

For example, U.S. Pat. No. 4,073,737 describes the preparation and hydrogenation of butadiene-isoprene copolymers.

(2) Hydrogenated Copolymers of Conjugated Dienes with Vinyl Substituted Aromatic Compounds In one embodiment, the hydrocarbon polymer is a hydrogenated copolymer of a vinyl-substituted aromatic compound and a conjugated diene.

As used herein, the term copolymer refers to polymers derived from 2 or more monomeric species. In this embodiment, one is a vinyl substituted aromatic compound and the other is an aliphatic conjugated diene.

The vinyl substituted aromatics generally contain from 8 to about 20 carbons, preferably from 8 to 12 carbon atoms and most preferably, 8 or 9 carbon atoms.

Examples of vinyl substituted aromatics include vinyl anthracenes, vinyl naphthalenes and vinyl benzenes (styrenic compounds). Styrenic compounds are preferred, examples being styrene, alpha-methystyrene, ortho-methyl styrene, meta-methyl styrene, para-methyl styrene, para-tertiary-butylstyrene, with styrene being preferred.

The conjugated dienes generally have from 4 to about 10 carbon atoms and preferably from 4 to 6 carbon atoms. Example of conjugated dienes include piperylene, 2,3-dimethyl-1,3-butadiene, chloroprene, isoprene and 1,3-butadiene, with isoprene and butadiene being particularly preferred. Mixtures of such conjugated dienes are useful.

The vinyl substituted aromatic content of these copolymers is typically in the range of about 20% to about 70% by weight, preferably about 40% to about 60% by weight. The aliphatic conjugated diene content of these copolymers is typically in the range of about 30% to about 80% by weight, preferably about 40% to about 60% by weight.

The polymers, and in particular, styrene-diene copolymers, can be random copolymers, regular block copolymers or random block copolymers. Random copolymers are those in which the comonomers are randomly, or nearly randomly, arranged in the polymer chain with no significant blocking of homopolymer of either monomer. Regular block copolymers are those in which a small number of relatively long chains of homopolymer of one type of monomer are alternately joined to a small number of relatively long chains of homopolymer of another type of monomer. Random block copolymers are those in which a larger number of relatively short segments of homopolymer of one type of monomer alternate with relatively short segments of homopolymer of another monomer.

The random, regular block and random block polymers used in this invention may be linear, or they may be partially or highly branched. The relative arrangement of homopolymer segments in a linear regular block or random block polymer is obvious. Differences in structure lie in the number and relative sizes of the homopolymer segments; the arrangement in a linear block polymer of either type is always alternating in homopolymer segments.

Normal or regular block copolymers usually have from 1 to about 5, often 1 to about 3, preferably only from 1 to about 2 relatively large homopolymer blocks of each monomer.

Thus, a linear regular diblock copolymer of styrene or other vinyl aromatic monomer (A) and diene (B) would have a general structure represented by a large block of homopolymer (A) attached to a large block of homopolymer (B), as:

$$(A)_a(B)_b$$

where a and b are as described hereinbelow. Techniques vary for the preparation of these "A-B-A" and "B-A-B" triblock polymers, and are described in the literature for anionic polymerization.

Similarly, a regular linear tri-block copolymer of styrene or other vinyl aromatic monomer (A) and diene monomer (B) may be represented, for example, by $$(A)_a(B)_b(C)_c.$$

the third monomer (C) may be incorporated into linear, regular block copolymers. Several configurations are possible depending on how the homopolymer segments are arranged with respect to each other. For example, linear triblock copolymers of monomers (A), (B) and (C) can be represented by the general configurations:

$$(A)a\text{-}(B)b\text{-}(C)c,\ (A)a\text{-}(C)c\text{-}(B)b,\ \text{or}\ (B)b\text{-}(A)a\text{-}(C)c,$$

wherein the lower case letters a, b and c represent the approximate number of monomer units in the indicated block.

The sizes of the blocks are not necessarily the same, but may vary considerably. The only stipulation is that any regular block copolymer comprises relatively few, but relatively large, alternating homopolymer segments.

As an example, when (A) represents blocks derived from diene such as isoprene or butadiene, "a" usually ranges from about 100 to about 2000, preferably from about 500 to about 1500; when (B) represents, for example, blocks derived from styrene, "b" usually ranges from about 100 to about 2000, preferably from about 200 to about 1000; and when a third block (C) is present, "c" usually ranges from about 10 to about 1000, provided that the $\overline{M}_n$ of the polymer is within the ranges indicated as useful for this invention.

The copolymers can be prepared by methods well known in the art. Such copolymers usually are prepared by anionic polymerization using Group Ia metals in the presence of electron-acceptor aromatics, or preformed organometallics such as sec-butyllithium as polymerization catalysts.

The styrene/diene block polymers are usually made by anionic polymerization, using a variety of techniques, and altering reaction conditions to produce the most desirable features in the resulting polymer. In an anionic polymerization, the initiator can be either an organometallic material such as an alkyl lithium, or the anion formed by electron transfer from a Group Ia metal to an aromatic material such as naphthalene. A preferred organometallic material is an alkyl lithium such as sec-butyl lithium; the polymerization is initiated by addition of the butyl anion to either the diene monomer or to the styrene.

When an alkyl lithium initiator is used, a homopolymer of one monomer, e.g., styrene, can be selectively prepared, with each polymer molecule having an anionic terminus, and lithium gegenion. The carbanionic terminus remains an active initiation site toward additional monomers. The resulting polymers, when monomer is completely depleted, will usually all be of similar molecular weight and composition, and the polymer product will be "monodisperse" (i.e., the ratio of weight average molecular weight to number average molecular weight is very nearly 1.0) At this point, addition of 1,3-butadiene, isoprene or other suitable anionically polymerizable monomer to the homopolystyrene-lithium "living" polymer produces a second segment which grows from the terminal anion site to produce a living diblock polymer having an anionic terminus, with lithium gegenion.

Subsequent introduction of additional styrene can produce a new poly A-block-poly B-block-poly A, or A-B-A triblock polymer; higher orders of block polymers can be made by consecutive stepwise additions of different monomers in different sequences.

Alternatively, a living diblock polymer can be coupled by exposure to an agent such as a dialkyl dichlorosilane. When the carbanionic "heads" of two A-B diblock living polymers are coupled using such an agent, precipitation of LiCl occurs to give an A-B-A triblock polymer.

Block copolymers made by consecutive addition of styrene to give a relatively large homopolymer segment (A), followed by a diene to give a relatively large homopolymer segment (B), are referred to as poly-A-block-poly-B copolymers, or A-B diblock polymers.

When metal naphthalide is employed as initiator, the dianion formed by electron transfer from metal, e.g., Na, atoms to the naphthalene ring can generate dianions which may initiate polymerization, e.g. of monomer A, in two directions simultaneously.

Subsequent exposure of the poly (A) dianion to a second monomer (B) results in formation of a polyB-block-polyA-block-polyB, or a B-A-B triblock polymeric dianion, which may continue to interact with additional anionically-polymerizable monomers of the same, or different chemical type, in the formation of higher order block polymers. Ordinary block copolymers are generally considered to have up to about 5 such blocks.

Usually, one monomer or another in a mixture will polymerize faster, leading to a segment that is richer in that monomer, interrupted by occasional incorporation of the other monomer. This can be used to build a type of polymer referred to as a "random block polymer", or "tapered block polymer. When a mixture of two different monomers is anionically polymerized in a non-polar paraffinic solvent, one will initiate selectively, and usually polymerize to produce a relatively short segment of homopolymer. Incorporation of the second monomer is inevitable, and this produces a short segment of different structure. Incorporation of the first monomer type then produces another short segment of that homopolymer, and the process continues, to give a "random" alternating distribution of relatively short segments of homopolymers, of different lengths. Random block polymers are generally considered to be those comprising more than 5 such blocks. At some point, one monomer will become depleted, favoring incorporation of the other, leading to ever longer blocks of homopolymer, in a "tapered block copolymer."

An alternative way of preparing random or tapered block copolymers involves initiation of styrene, and interrupting with periodic, or step, additions of diene monomer. The additions are programmed according to the relative reactivity ratios and rate constants of the styrene and particular diene monomer.

"Promoters" are electron-rich molecules that facilitate anionic initiation and polymerization rates while lessening the relative differences in rates between various monomers. Promoters also influence the way in which diene monomers are incorporated into the block polymer, favoring 1,2-polymerization of dienes over the normal 1,4-cis- addition.

Hydrogenation of the unsaturated block polymers initially obtained produces polymers that are more oxidatively and thermally stable. Techniques for accomplishing hydrogenation are well known to those of skill in the art. Briefly, hydrogenation is accomplished by contacting the copolymers with hydrogen at superatmospheric pressures in the presence of a metal catalyst such as colloidal nickel, palladium supported on charcoal, etc. and may be carried out as part of the overall production process, using finely divided, or supported, nickel catalyst. Other transition metals may also be used to effect the transformation. Hydrogenation is normally carried out to reduce approximately 94–96% of the olefinic unsaturation of the initial polymer. In general, it is preferred that these copolymers, for reasons of oxidative stability, contain no more than about 10%, preferably no more than 5% and more preferably no more than about 0.5% residual olefinic unsaturation on the basis of the total amount of olefinic double bonds present in the polymer prior to hydrogenation. Such unsaturation can be measured by a number of means well known to those of skill in the art, such as infrared or nuclear magnetic resonance spectroscopy. Most preferably, these copolymers contain no significant olefinic unsaturation. Aromatic unsaturation is not considered to be olefinic unsaturation within the context of this invention.

Other polymerization techniques such as emulsion polymerization can be used.

Often the arrangement of the various homopolymer blocks is dictated by the reaction conditions such as catalyst and polymerization characteristics of the monomers employed. Conditions for modifying arrangement of polymer blocks are well known to those of skill in the polymer art. Literature references relating to polymerization techniques and methods for preparing certain types of block polymers include:

1) "Encyclopedia of Polymer Science and Engineering", Wiley-Interscience Publishing, New York, (1986);

2) A. Noshay and J. E. McGrath, "Block Copolymers", Academic Press, New York, (1977);

3) R. J. Ceresa, ed., "Block and Graft Copolymerization", John Wiley and Sons, New York, (1976); and 4) D. J. Meier, ed., (Block Copolymers", MMI Press, Harwood Academic Publishers, New York, (1979).

Each of these is hereby incorporated herein by reference for relevant disclosures relating to block copolymers.

Examples of suitable regular diblock copolymers as set forth above include Shellvis-40, and Shellvis-50, both hydrogenated styrene-isoprene block copolymers, manufactured by Shell Chemical.

Examples of commercially available random block copolymers include the various Glissoviscal block copolymers manufactured by BASF. A previously available random block copolymer was Phil-Ad viscosity improver, manufactured by Phillips Petroleum.

The copolymers preferably have number average molecular weights ($\overline{M}_n$) in the range of about 20,000 to about 500,000, more preferably from about 30,000 to about 150,000. The weight average molecular weight ($\overline{M}_w$) for these copolymers is generally in the range of about 50,000 to about 500,000, preferably from about 50,000 to about 300,000.

(3) Polymers of Alpha-Olefins

Another hydrocarbon polymer onto which acid functionality is grafted is a polymer, a polyolefin, which consists in its main chain essentially of alpha olefin monomers. The polyolefins of this embodiment thus exclude polymers which have a large component of other types of monomers copolymerized in the main polymer backbone, such as ester monomers, acid monomers, and the like. The polyolefin may contain impurity amounts of such materials, e.g., less than 5% by weight, more often less than 1% by weight, preferably, less than 0.1% by weight of other monomers.

Useful polymers include oil soluble or dispersible substantially saturated, including hydrogenated, polymers of alpha-olefins. By substantially saturated is meant that no more than about 5% of the carbon to carbon bonds in the polymer are unsaturated. Preferably, no more than 1% are unsaturated, more preferably, the polymer is essentially free of unsaturation.

These polymers are preferably copolymers, more preferably copolymers of ethylene and at least one other α-olefin having the formula $CH_2{=}CHR_1$ wherein $R_1$ is straight chain or branched chain alkyl radical comprising 1 to 26 carbon atoms. Preferably $R_1$ in the above formula is alkyl of from 1 to 8 carbon atoms, and more preferably is alkyl of from 1 to 2 carbon atoms.

The ethylene content is preferably in the range of 20 to 80 percent by weight, and more preferably 30 to 70 percent by weight. When propylene and/or 1-butene are employed as comonomer(s) with ethylene, the ethylene content of such copolymers is most preferably 45 to 65 percent, although higher or lower ethylene contents may be present. Most preferably, these polymers are substantially free of ethylene homopolymer, although they may exhibit a degree of crystallinity due to the presence of small crystalline polyethylene segments within their microstructure. Preferred polymers are copolymers of ethylene and propylene and ethylene and 1-butene.

The alpha olefin copolymer preferably has a number average molecular weight ($M_n$) determined by gel-permeation chromatography employing polystyrene standards, ranging from about 30,000 to about 300,000, more often from about 50,000 to about 150,000, even more often from about 80,000 to 150,000. Exemplary polydispersity values ($\overline{M}_w/\overline{M}_n$) range from about 2.2 to about 2.5.

The polymers employed in this embodiment may generally be prepared substantially in accordance with procedures which are well known in the art. The polymers for use in this embodiment can be prepared by polymerizing monomer mixtures comprising alpha-olefins. The monomers are alpha-olefins containing from 2 to about 28 carbon atoms, and may be branched chain or linear. In a preferred embodiment, one monomer is ethylene, the comonomer being at least one $C_{3-28}$ alpha olefin, preferably $C_{3-8}$ alpha olefins, including monoolefins such as propylene, 1-butene, isobutene, 1-pentene, 1-hexene, 1-heptene, 1-octene, 1-nonene, 1-decene, propylene tetramer, diisobutylene, and triisobutylene.

Catalysts employed in the production of the reactant polymers are likewise well known. One broad class of catalysts particularly suitable for polymerization of α-olefins, comprises coordination catalysts such as Ziegler or Ziegler-Natta catalysts comprising a transition metal atom. Ziegler-Natta catalysts are composed of a combination of a transition metal atom with an organo aluminum halide and may be used with additional complexing agents.

Polymerization using coordination catalysis is generally conducted at temperatures ranging between 20° and 300° C., preferably between 30° and 200° C. Reaction time is not critical and may vary from several hours or more to several minutes or less, depending upon factors such as reaction temperature, the monomers to be copolymerized, and the like. One of ordinary skill in the art may readily obtain the optimum reaction time for a given set of reaction parameters by routine experimentation. Preferably, the polymerization will generally be completed at a pressure of 1 to 40 MPa (10 to 400 bar).

The polymerization may be conducted employing liquid monomer, such as liquid propylene, or mixtures of liquid monomers (such as mixtures of liquid propylene and 1-butene), as the reaction medium. Alternatively, polymerization may be accomplished in the presence of a hydrocarbon inert to the polymerization such as butane, pentane, isopentane, hexane, isooctane, decane, toluene, xylene, and the like.

When carrying out the polymerization in a batch-type fashion, the reaction diluent (if any) and the alpha-olefin comonomer(s) are charged at appropriate ratios to a suitable reactor. Care should be taken that all ingredients are dry, with the reactants typically being passed through molecular sieves or other drying means prior to their introduction into the reactor. Subsequently, component(s) of the catalyst are introduced while agitating the reaction mixture, thereby causing polymerization to commence. Alternatively, component(s) of the catalyst may be premixed in a solvent and then fed to the reactor. As polymer is being formed, additional monomers may be added to the reactor. Upon completion of the reaction, unreacted monomer and solvent are either flashed or distilled off, if necessary by vacuum, and the copolymer withdrawn from the reactor.

The polymerization may be conducted in a continuous manner by simultaneously feeding the reaction diluent (if employed), monomers, component(s) of the catalyst to a reactor and withdrawing solvent, unreacted monomer and polymer from the reactor so as to allow a residence time of ingredients long enough for forming polymer of the desired molecular weight; and separating the polymer from the reaction mixture.

In those situations wherein the molecular weight of the polymer product that would be produced at a given set of operating conditions is higher than desired, any of the techniques known in the prior art for control of molecular weight, such as the use of hydrogen and/or polymerization temperature control, may be used.

However, the polymers are preferably formed in the substantial absence of added $H_2$ gas, that is $H_2$ gas added in amounts effective to substantially reduce the polymer molecular weight.

The polymers can be random copolymers, block copolymers, and random block copolymers. Ethylene propylene copolymers are usually random copolymers Numerous United States patents, including the following, describe the preparation of copolymers of alpha olefins.

| | |
|---|---|
| 3,513,096 | 4,068,057 |
| 3,551,336 | 4,081,391 |
| 3,562,160 | 4,089,794 |
| 3,607,749 | 4,098,710 |
| 3,634,249 | 4,113,636 |
| 3,637,503 | 4,132,661 |
| 3,992,310 | 4,137,185 |
| 4,031,020 | 4,138,370 |
| 4,068,056 | 4,144,181 |

Copolymers of ethylene with higher alpha olefins are the most common copolymers of aliphatic olefins and ethylene-propylene copolymers are the most common ethylene-alpha-olefin copolymers and are preferred for use in this invention. A description of an ethylene-propylene copolymer appears in U.S. Pat. No. 4,137,185 which is hereby incorporated herein by reference.

Useful ethylene-alpha olefin, usually ethylene-propylene, copolymers are commercially available from numerous sources including the Exxon, Texaco and Lubrizol Corporations.

(4) Olefin-Diene Copolymers

Another useful hydrocarbon monomer is one derived from olefins, especially lower olefins, and dienes. Dienes may be non-conjugated or conjugated. Useful olefins and dienes are the same as those described hereinabove and hereinafter in discussions of other polymer types.

In one embodiment, the copolymer is an ethylene-lower olefin-diene copolymer. As used herein, the term lower refers to groups or compounds containing no more than 8 carbon atoms. Preferably, the diene is non-conjugated.

There are numerous commercial sources for lower olefin-diene polymers. For example, Ortholeum® 2052 (a product marketed by the DuPont Company) which is a terpolymer having an ethylene:propylene weight ratio of about 57:43 and containing 4–5 weight % of groups derived from 1–4 hexadiene monomer, and numerous other such materials are readily available. Olefin-dienes copolymers and methods for their preparation are described in numerous patents including the following U.S. Patents:

U.S. Pat. No. 3,291,780

U.S. Pat. No. 3,300,459

U.S. Pat. No. 3,598,738

U.S. Pat. No. 4,026,809

U.S. Pat. No. 4,032,700

U.S. Pat. No. 4,156,061

U.S. Pat. No. 3,320,019

U.S. Pat. No. 4,357,250

U.S. Pat. No. 3,598,738, which describes the preparation of ethylene-propylene-1,4-hexadiene terpolymers, is illustrative. This patent also lists numerous references describing the use of various polymerization catalysts.

Another useful polymer is an olefin-conjugated diene copolymer. An example of such a polymer is butyl rubber, an isobutylene-isoprene copolymer.

Details of various types of polymers, reaction conditions, physical properties, and the like are provided in the above patents and in numerous books, including:

"Riegel's Handbook of Industrial Chemistry", 7th edition, James A. Kent Ed., Van Nostrand Reinhold Co., New York (1974), Chapters 9 and 10, P. J. Flory, "Principles of Polymer Chemistry", Cornell University Press, Ithaca, N.Y. (1953), "Kirk-Othmer Encyclopedia of Chemical Technology", 3rd edition, Vol 8 (Elastomers, Synthetic, and various subheadings thereunder), John Wiley and Sons, New York (1979).

Each of the above-mentioned books and patents is hereby expressly incorporated herein by reference for relevant disclosures contained therein.

Polymerization can also be effected using free radical initiators in a well-known process, generally employing higher pressures than used with coordination catalysts.

(5) Star Polymer

Star polymers are polymers comprising a nucleus and polymeric arms. Common nuclei include polyalkenyl compounds, usually compounds having at least two non-conjugated alkenyl groups, usually groups attached to electron withdrawing groups, e.g., aromatic nuclei. The polymeric arms are often homopolymers and copolymers of conjugated dienes and monoalkenyl arenes and mixtures thereof.

The polymers thus comprise a poly(polyalkenyl coupling agent) nucleus with polymeric arms extending, outward therefrom. The star polymers are usually hydrogenated such that at least 80% of the covalent carbon-carbon bonds are saturated, more often at least 90% and even more preferably, at least 95% are saturated.

The polyvinyl compounds making up the nucleus are illustrated by polyalkenyl arenes, e.g., divinyl benzene and poly vinyl aliphatic compounds.

Dienes making up the polymeric arms are illustrated by, butadiene, isoprene and the like. Monoalkenyl compounds include, for example, styrene and alkylated derivatives thereof.

Star polymers are well known in the art. Such material and methods for preparing same are described in numerous publications and patents, including the following United States patents which are hereby incorporated herein by reference for relevant disclosures contained therein:

U.S. Pat. No. 4,116,917,

U.S. Pat. No. 4,141,847,

U.S. Pat. No. 4,346,193,

U.S. Pat. No. 4,358,565, and

U.S. Pat. No. 4,409,120.

Star polymers are commercially available, for example as Shellvis 200 sold by Shell Chemical Co.

The Ethylenically Unsaturated Carboxylic Acid or Functional Derivative thereof

The ethylenically unsaturated carboxylic acids or functional derivatives are well know in the art. The most commonly used materials contain from to to about 20 carbon atoms exclusive of carbonyl carbons. They include such acids as acrylic acid, methacrylic acid, maleic acid, fumaric acid, crotonic acid, citraconic acid, itaconic acid and mesaconic acid, as well as their anhydrides, halides and esters (especially the lower alkyl esters, the term "lower alkyl" meaning alkyl groups having up to 7 carbon atoms). The preferred compounds are the alpha-beta-olefinic carboxylic acids, especially those containing at least two carboxy groups and more especially dicarboxylic acids, and their derivatives. Maleic acid and maleic anhydride, especially the latter, are particularly preferred.

Reactant (a) is prepared by grafting, either by mastication of the neat polymer, or in solution, the ethylenically unsaturated carboxylic acid or functional derivative onto the ethylene copolymer backbone employing techniques that are well-known in the art. Free-radical grafting techniques are usually employed. Thermal grafting by the "ene" reaction using copolymers containing unsaturated sites, such as ethylene-propylene-diene copolymers may be employed.

The ethylenically unsaturated carboxylic acid is generally employed in amounts ranging from about 0.01% to 10% preferably 0.1–5%, more preferably 0.2–2% by weight; based on the weight of polymer.

Free Radical-Generating Reagents

Radical grafting is preferably carried out using free radical initiators such as peroxides, hydroperoxides, and azo compounds which decompose thermally within the grafting temperature range to provide said free radicals.

Free radical generating reagents are well know to those skilled in the art. Examples include benzoyl peroxide, t-butyl perbenzoate, t-butyl metachloroperbenzoate, t-butyl peroxide, sec-butylperoxydicarbonate, azobisisobutyronitrile, and the like. Numerous examples of free radical-generating reagents, also known as free-radical initiators, are mentioned in the above-referenced tests by Flory and by Bovey and Winslow. An extensive listing of free-radical initiators appears in J. Brandrup and E. H. Immergut, Editor, "Polymer Handbook", 2nd edition, John Wiley and Sons, New York (1975), pages II-1 to II-40. Preferred free radical-generating reagents include t-butyl peroxide, t-butyl hydroperoxide, t-amyl peroxide, cumyl peroxide, t-butyl peroctoate, t-butyl-m-chloroperbenzoate and azobisisovaleronitrile.

The free-radical initiators are generally used in an amount from 0.01 to about 10 percent by weight based on the total weight of the reactants. Preferably, the initiators are used at about 0.05 to about 1 percent by weight.

The reaction is usually conducted at temperatures ranging between about 80° C. to about 200° C., preferably between about 130° C. to about 170° C. Considerations for determining reaction temperatures include reactivity of the system and the half-life of the initiator at a particular temperature.

The choice of free radical generating reagent can be an important consideration. For example, when a polymer undergoing grafting with a monomer is diluted with a solvent such as a hydrocarbon oil, grafting of the monomer onto the oil diluent may occur. It has been observed that the choice of initiator affects the extent of grafting of the monomer onto the oil diluent. Reducing the amount of monomer grafted onto the diluent usually results in an increased amount of monomer grafted onto the polymer backbone. Improved efficiency of monomer grafting onto substantially saturated copolymer resins has been described by Lange et al. in U.S. Pat. No. 5,298,565 which is hereby incorporated herein by reference for relevant disclosures in this regard.

Azo group containing initiators, such as Vazo® polymerization initiators (DuPont) employed in the grafting process at about 95° C. result in a much higher degree of grafting onto the polymer backbone than do peroxide initiators such as t-butyl peroxide, employed at about 150–160° C. Peresters are particularly effective in the free-radical grafting process.

(b) The Amine Reactant

The amine is selected from the group consisting of (b-1) a polyamine product having at least one N—H group made by contacting at least one hydroxy-containing material (b-i) having the general formula $$(R)_nY_z—X_p—(A(OH)_q)_m \quad (I)$$

wherein each R is independently H or hydrocarbon based group, Y is selected from the group consisting of O, N, and S, X is a polyvalent hydrocarbon based group, A is a polyvalent hydrocarbon based group, preferably an alkylene group, n is 1 or 2, z is 0 or 1, p is 0 or 1, q ranges from 1 to about 10, and m is a number ranging from 1 to about 10; with (b-ii) at least one amine having at least one N—H group, and (b-2) an acylated derivative of (b-1) containing at least one condensable N—H group.

(b-1) The Polyamine Product

The polyamine product (b-1) is characterized by the presence within its structure of at least one HN<group. Mixtures of two or more amino compounds can be used in the reaction. Preferably, the polyamine contains at least one primary amino group (i.e., —$NH_2$) and more preferably is a polyamine containing at least two condensable —NH— groups. The amines may be aliphatic, cycloaliphatic, aromatic or heterocyclic amines. The polyamines not only result in carboxylic acid derivative compositions which are usually more effective as dispersant/detergent additives, relative to derivative compositions derived from monoamines, but polyamines result in carboxylic derivative compositions which exhibit more pronounced viscosity improving properties.

When the amine is (b-1) the polyamine product, it is preferred that the grafted copolymer (a) is characterized by the presence of less than 2 moles of grafted carboxylic acid or functional derivative thereof per equivalent of hydrocarbon polymer.

b(i) The Hydroxy Compound

The hydroxy compound has the general formula $(R)_nY_z$—$X_p$—$(A(OH)_q)_m$ wherein the various groups in the formula are defined hereinabove.

The hydroxy material (b-i) can be any hydroxy material that will condense with the amine reactants (b-ii). These hydroxy materials can be aliphatic, cycloaliphatic, or aromatic; monools and polyols. Aliphatic compounds are preferred, and polyols are especially preferred. Highly preferred are aminoalcohols, especially those containing more than one hydroxyl group. Typically, the hydroxy-containing material (b-i) contains from 1 to about 10 hydroxy groups.

Monools useful as (b-i) are primary or secondary, preferably alkyl, monohydric compounds, preferably containing from 1 to about 100 carbon atoms, more preferably up to about 28 carbon atoms, Examples include methanol, ethanol, butanols, cyclohexanol, 2-methylcyclohexanol, isomeric octanols and decanols, octadecanol, behenyl alcohol, neopentyl alcohol, benzyl alcohol, beta-phenylethyl alcohol, and chloroalkanols.

Further examples are monoether- and polyether-containing monools derived from oxyalkylation of alcohols, carboxylic acids, amides, or phenolic materials, by reaction with alkylene oxides. When two or more different alkylene oxides are employed, they may be used as mixtures or consecutively, as discussed in greater detail herinbelow. These ether-containing monools can be represented by the general structure:

$$R\text{-}(OR^1)_a\text{-}(OR^2)_b\text{-}(OR^3)_cOH$$

wherein R=hydrocarbyl, acyl, or carboxamidoalkyl; preferably containing from 1 to about 28 carbon atoms, each of $R^1$, $R^2$ and $R^3$ is hydrocarbylene containing from 2 to about 12 carbon atoms, more often 2 or 3 carbon atoms; a, b, and c=0–100, provided that the total of a, b, and c is at least 1. When R is hydrocarbyl, it may be alkyl-, aryl-, arylalkyl-, or alkylaryl-. In one embodiment, a and b may from zero to about 12, preferably from zero to about 6, while in another embodiment, a and b range up to about 100.

Examples include 2-alkoxyethanols, members of the "Cellosolve" family of glycol ethers made by Union Carbide Corporation, and 2-(polyalkoxy)ethanol. Other commercially available products of alcohol alkoxylation include Neodol® ethoxylated linear and branched alcohols from Shell Chemical, Alfonic® ethoxylated linear alcohols from Vista Chemical, propoxylated alcohols from ARCO Chemicals, UCON® propoxylated alcohols from Union Carbide, Provol® propoxylated fatty alcohols from Croda Chemical, and Carbowax methoxy polyethylene glycols, such as Carbowax® 350 and 750 from Union Carbide.

Aryl analogs of lower ether-containing monools include, for example, 2-(nonylphenoxyethyloxy)ethanol, 2-(octylphenoxyethyl-oxyethyloxy)ethanol and higher homologs made using greater amounts of alkylene oxides, marketed under the TRITON® trademark by Union Carbide.

As noted hereinabove, polyether monools may also be prepared by condensation of 2 or more different alkylene oxides, in mixtures or consecutively, with alcohols, alkylphenols or amides, Commercially available polyether monools made from reaction of mixtures of ethylene oxide and propylene oxide with butanol are represented by the UCON® 50-HB- and 75-HB-series of functional fluids from Union Carbide, while similar products from mixtures of propylene oxide and higher (e.g., C4–C10) alkylene oxides are sold by BP Chemicals under the Breox® tradename.

Polyols are defined herein as compounds containing at least two hydroxy groups.

Dihydroxy compounds include alkylene glycols of general structure HO—(—R—)—OH, wherein R is hydrocarbylene. Examples are ethylene glycol, 1,2-propanediol, 1,2-, 1,3- and 1,4-butylenediols, 1,6-hexanediol, neopentylene glycol, 1,10-decanediol, cyclohexane-1,4-diol and 1,4-bis-(hydroxymethyl) cyclohexane.

Other diols include ether-diols and polyether diols (glycols). These may be represented by the general structure:

$$HO\text{-}(OR^1)_a\text{-}(OR^2)_b\text{-}(OR^3)_cOH$$

wherein $R^1$, $R^2$ and $R^3$ are independently $C_2$–$C_{12}$ hydrocarbylene, more often ethylene or propylene, and a, b and c are independently zero to about 100, provided that the total of a, b, and c is at least 1. Examples of ether- and polyether-diols are diethylene glycol, triethylene glycol, tetraethylene glycol, dipropylene glycol, 2-(2-hydroxyethyloxy)-1-propanol and 1,2-bis-(2-hydroxypropyloxy)ethane, polyoxyalkylene oxides of the Carbowax® family of polyethylene glycols from Union Carbide, the Pluronic® P-series of polypropylene oxide diols from BASF, polyoxybutylene glycols from Dow Chemical, and the like.

In addition to monools and diols, other useful alcohols include polyhydric alcohols having three or more HO— groups, preferably those containing up to about 12 carbon atoms, and especially those containing from about 3 to about 10 carbon atoms. Useful polyhydric polyols include, glycerol, trimethylol propane, 2-ethyl-2-hydroxymethyl-1, 3-propanediol, erythritol, pentaerythritol, dipentaerythritol, glucose, arabinose, 1,2,3-hexane triol, 2,3,4-hexanetriol, butanetriols, and polyglycerols (including the ether-coupled glycerol dimer, trimer, tetramer, etc.)

Aminoalcohols are useful hydroxy containing compounds. Aminoalcohols may be aliphatic, cycloaliphatic or aromatic, containing at least one hydroxy group and preferably contain two or more hydroxy groups. These may be prepared by methods known in the art, for example, by reaction of an amine having at least one N—H group with an alkylene oxide. Another procedure is to condense an aldehyde, particularly formaldehyde, with a nitro compound followed by reduction of nitro groups.

Useful aminoalcohols include monoamino and polyamino compounds. These may be monohydroxy or polyhydroxy compounds, depending, for example on the extent of reaction with alkylene oxide. For example, a primary amine may react with one or two alkylene oxides, forming mono- or di-hydroxyalkylamines. Polyalkoxy ether containing aminoalcohols are also useful. These may be prepared by reaction of ammonia or a primary or secondary amine with an excess of alkylene oxide.

Some of the more useful aminoalcohols for the purpose of this invention are the reduced condensation products of formaldehyde with nitroalkanes. Particularly useful are 2-amino-2-(2-hydroxymethyl)-1,3-propane-diol (commonly known as "THAM", or "TrisAmino"), 2-amino-2-ethyl-1,3-propanediol, and 2-amino-2-methyl-1,3-propanediol.

Examples of other useful aminoalcohols include N-(N)-hydroxy-lower alkyl) amines and polyamines such as di-(2-hydroxyethyl)amine, aminoethanol, triethanolamine, dibutylaminoethanol, tris(hydroxypropyl)amine, N,N,N',N'-tetra-(hydroxyethyl)trimethylene-diamine, and the like.

Examples of commercially available oxyalkylated amines include members of the Ethomeen® and Propomeen® series of ethoxylated and propoxylated primary and secondary amines from AKZO Chemie. Ethylene diamine/propylene oxide products constitute the Tetronic® family of polyoxyalkylated diamine available from BASF/Wyandotte Corporation.

Reaction of ethylene oxide or propylene oxide with polyglycolamine from Union Carbide gives the corresponding di-(2-hydroxyalkyl)-ether amine. Similar reaction of these alkylene oxides with Jeffamine® polyoxypropylamines from Huntsman Chemical results in the formation of N-hydroxyalkylated derivatives. Corresponding products may be made by hydroxyalkylation of 3-(higher alkyloxy) propylamines.

Other useful hydroxy-containing reactants are hydroxyalkyl-, hydroxyalkyl oxyalkyl-, and corresponding aryl derivatives thereof, sulfides of the formula $$R—S_a—(R^1O)_bH$$

wherein R is a hydrocarbyl or hydroxyhydrocarbyl group containing from 1 to about 22 carbon atoms, $R^1$ is a hydrocarbylene group containing 2 to 10 carbons, a is 1 or 2; and b ranges from 1 to about 20. Examples include 2-(dodecylthio)ethanol, thiodiethanol, and 2-hydroxyethyl disulfide.

(b-ii) The Amine

The amine b(ii) contains at least one N—H group. Among the preferred amines making up b(ii) are the alkylene polyamines, including the polyalkylene polyamines. The alkylene polyamines include those conforming to the formula $$\begin{array}{c} R_2N—(U—N)_a—R_2 \\ \quad\;\; | \qquad\quad\; | \\ \quad\;\; R_2 \qquad\quad R_2 \end{array}$$

wherein n is from 1 to about 10; each $R_2$ is independently a hydrogen atom, a hydrocarbyl group or a hydroxy-substituted or amine-substituted hydrocarbyl group having up to about 30 atoms, or two $R_2$ groups on different nitrogen atoms can be joined together to form a U group, with the proviso that at least one $R_2$ group is a hydrogen atom and U is an alkylene group of about 2 to 10 carbon atoms. Preferably U is ethylene or propylene. Especially preferred are the alkylene polyamines where each $R_2$ is hydrogen or an amino-substituted hydrocarbyl group with the ethylene polyamines and mixtures of ethylene polyamines being the most preferred. Usually n will have an average value of from 2 to about 7. Such alkylene polyamines include methylene polyamine, ethylene polyamines, butylene polyamines, propylene polyamines, pentylene polyamines, hexylene polyamines, heptylene polyamines, etc. The higher homologs of such amines and related amino alkyl-substituted piperazines are also included.

Alkylene polyamines useful in preparing the polyamine product b-1 include ethylene diamine, triethylene tetramine, propylene diamine, trimethylene diamine, hexamethylene diamine, decamethylene diamine, hexamethylene diamine, decamethylene diamine, octamethylene diamine, di(heptamethylene)triamine, tripropylene tetramine, tetraethylene pentamine, trimethylene diamine, pentaethylene hexamine, di(trimethylene)triamine, N-(2-aminoethyl) piperazine, 1,4-bis(2-aminoethyl)piperazine, and the like. Higher homologous as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7 pages 27–39, Interscience Publishers, Division of John Wiley and Sons, 1965, and in Meinhardt et al., U.S. Pat. No. 4,234,435, both of which are hereby incorporated by reference for the disclosure of useful polyamines. Such compounds are prepared most conveniently by the reaction of an alkylene dichloride with ammonia or by reaction of an ethylene imine with a ring-opening reagent such as ammonia, etc. These reactions result in the production of the somewhat complex mixtures of alkylene polyamines, including cyclic condensation products such as piperazines. The mixtures are particularly useful. On the other hand, quite satisfactory products can also be obtained by the use of pure alkylene polyamines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than two, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex. designated "E-100" showed a specific gravity at 15.6° C. of 1.0168, a percent nitrogen by weight of 33.15 and a viscosity at 40° C. of 121 centistokes. Gas chromatography analysis of such a sample showed it to contain about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher linear and branched analogs of diethylenetriamine, triethylenetetramine and the like.

In another embodiment, the polyamine may be a hydroxyamine provided that the polyamine contains at least one condensable —N—H group. Typically, the hydroxyamines are primary or secondary alkanol amines or mixtures thereof. Such amines can be represented by mono- and poly-N-hydroxyalkyl substituted alkylene polyamines wherein the alkylene polyamines are as described hereinabove; especially those that contain two to three carbon atoms in the alkylene radicals and the alkylene polyamine contains up to seven amino groups.

Preferred combination of reactants for making the polyamines of the present invention include those in which reactant (b-i) is a polyhydric alcohol having three hydroxyl groups or an amino alcohol having two or more hydroxy groups and reactant (b-ii) is an alkylene polyamine having at least two primary nitrogen atoms and wherein the alkylene group contains 2 to about 10 carbon atoms. The reaction is conducted in the presence of an acid catalyst at an elevated temperature. Catalysts useful for the purpose of this invention include mineral acids (mono, di- and poly basic acids) such as sulfuric acid and phosphoric acid; organophosphorus acids and organo sulfonic acids, alkali and alkaline earth partial salts of $H_3PO_4$ and $H_2SO_4$, such as $NaHSO_4$, $LiHSO_4$, $KHSO_4$, $NaH_2PO_4$, $LiH_2PO_4$ and $KH_2PO_4$; $CaHPO_4$, $CaSO_4$ and $MgHPO_4$; also $Al_2O_3$ and Zeolites. Phosphorus and phosphoric acids and their esters or partial esters are preferred because of their commercial availability and ease of handling. Also useful as catalysts are materials which generate acids when treated in the reaction mixture, e.g., triphenylphosphite. Catalysts are subsequently neutralized with a metal-containing basic material such as alkali metal, especially sodium, hydroxides.

The reaction is run at an elevated temperature which can range from 60° C. to about 265° C. Most reactions, however, are ran in the 220° C. to about 250° C. range. The reaction may be run at atmospheric pressure or optionally at a reduced pressure. The degree of condensation of the resultant high molecular weight polyamine prepared by the process is limited only to the extent to prevent the formation of solid products under reaction conditions. The control of the degree of condensation of the product of the present invention is normally accomplished by limiting the amount of the condensing agent, i.e., the hydroxyalkyl or hydroxy aryl reactant charged to the reaction. The resulting product frequently contains the neutralized catalyst and significant amounts by weight, from about 0.1% , often at least 1%, frequently 5% up to 20%, often up to 10%, water.

The preparation of various polyamine products is illustrated in the following examples. All percentages and all parts are by weight unless otherwise clearly indicated. Temperatures are in degrees Celsius. Filtrations are conducted using a diatomaceous earth filter aid.

EXAMPLE (b-1)-1

A reactor is charged with 1000 parts of an ethylene polyamine bottoms identified as HPA-X (Union Carbide) and 613 parts of 40% aqueous tris-hydroxymethylaminomethane (THAM). An $N_2$ purge is started and is maintained throughout processing The materials are heated to 49° C. whereupon 15.9 parts 85% aqueous phosphoric acid are added and the temperature is increased to 177° C. Conditions are adjusted to enable condensation and reflux of the amine while allowing water to be removed from the system. The temperature is then increased to 227° C. and is held at 227–232° C. for 10 hours while refluxing the amines. The mixture is then stripped by heating at 232–238° C. for 6 hours, then is rapidly cooled to 93° C. whereupon 127 parts water are added followed by the addition of 22.1 parts 50% aqueous NaOH. The batch is mixed for 4 hours at 88–93° C. The unfiltered product contains 27% N, 0.35% P, and 11% $H_2O$.

EXAMPLE (b-1)-2

4 A necked, 500-ml, round-bottom flask equipped with glass stirrer, thermowell, subsurface $N_2$ inlet, Dean-Stark trap, and Friedrich condenser is charged with 201 parts of tetraethylenepentamine (TEPA), 151 parts of 40% aqueous THAM, and 3.5 parts of 85% $H_3PO_4$. The mixture is heated to 120° C. over 1.0 hour. With $N_2$ sweeping, the mixture is heated to 130° C. over 1 hour and to 230° C. over 2 hours more. The temperature is maintained at 230°–240° C. for 4 hours and at 241°–250° C. for 3 hours. The materials are cooled to 150° C. and filtered.

EXAMPLE (b-1)-3

A 4 necked, 3–1, round-bottom flask equipped with glass stirrer, thermowell, subsurface $N_2$ inlet, Dean-Stark trap, and Friedrich condenser is charged with 1299 parts HPA Taft Amines (amine bottoms), 727 parts 40% aqueous tris (hydroxymethyl)-aminomethane, heated to 60° C. whereupon 23 parts 85% $H_3PO_4$ are added. The mixture is heated to 120° C. over 0.6 hr. With $N_2$ sweeping, the mixture is heated to 150° C. over 1.25 hr and to 235° C. over 1 hr. more. The materials are held at 230°–235° C. for 5 hours. The temperature is increased to 240° C. over 0.75 hour and is held at 240°–245° C. for 5 hour. The materials are cooled to 1500° C. and filtered. Yield: 84%.

EXAMPLE (b-1)-4

A 3-liter flask equipped with stirrer, thermowell, below surface $N_2$ inlet and a stripping condenser is charged with 363 parts of THAM and 1200 parts of TEPA. Next are added 16 parts of $H_3PO_4$ at 110° C. $N_2$ blowing is commenced at 120 cc/min. The mixture is heated to 220° C. in 0.8 hour and held at 220°–225° C. for 1.2 hour; then heated to 230° C. in 0.2 hour and held at 230° C. for 4.75 hours: 129 parts distillate collected. The mixture is held at 242°–245° C. for 5 hours: 39 parts additional distillate is collected. Temperature is maintained at 246°–255° C. for 1.2 hr: 178 parts material in trap. The mixture is filtered at 155° C.

EXAMPLE (b-1)-5

A 3-liter flask equipped with stirrer, thermowell, below surface $N_2$ inlet and a stripping condenser was charged with 363 parts THAM and 1200 parts TEPA. At 100° C. are added 16 parts $H_3PO_4$. $N_2$ blowing is commenced at 95 cc/min. The mixture is heated to 165° C. in 0.4 hour; and to 241° C. in 0.6 hour, then held at 241°–243° C. for 0.3 hour. The contents are further heated to 250° C. for an additional 0.5 hour and held at 250° C. for 5.5 hour: 288 parts distillate are collected in the trap. Materials are filtered at 150° C.

EXAMPLE (b-1)-6

A 1-liter flask equipped with stirrer, thermowell, below surface $N_2$ inlet and Dean-Stark trap was charged with 121 parts THAM and 400 parts TEPA. To this mixture are added 8.2 parts of $KH_2PO_4$ at 60° C. $N_2$ blowing is commenced at 70 cc/min. The reaction mixture is heated to 150° C. over 1 hour, and to 230° C., over 1.5 hours. The temperature is held at 230° C.–232° C. for 4.25 hour: 17 parts material collected in trap. The mixture is held at 237° C. for 3.25 hour: 38 parts material collected in trap. The mixture is further heated to 241° C. over 0.75 hour and is held at 241° C.–242° C. for 4.75 hour; 50 parts material collected in trap. The material is held at 250° C. for 5 hour; total of 53 parts material collected in trap. Filter at 150° C.

EXAMPLE (b-1)-7

To a 500 ml flask equipped with stirrer, thermowell, below surface $N_2$ inlet and Dean-Stark trap is charged with 201 parts TEPA and 468 parts glycerol. 2.3 parts $H_3PO_4$ are added at 80° C. $N_2$ blowing is commenced at 165 cc/min. The mixture is heated to 220° C. over 2 hours; to 240° C. in 1 hour; to 245° C. in 1.5 hour and to 255° C. in 1 hour. The temperature is held at 255°–252° C. for 2 hours: 12 parts material collected in trap. The mixture is held at 255°–262° C. for 7 hours: 34 parts distillate collected in trap. The temperature of the mixture is held at 255°–260° C. for 1 hour more. A total of 36 parts distillate is collected in trap. Filter at 130° C.

EXAMPLE (b-1)-8

To a 500 ml flask equipped with stirrer, thermowell, below surface $N_2$ inlet and Dean-Stark trap are charged 201 parts TEPA and 45 parts hexaglycerol. To this mixture 3.5 parts $H_3PO_4$ are added at 85° C. $N_2$ blowing is commenced at 165 cc/min. The mixture is heated to 245° C. over 0.7 hour and held at 245° C.–260° C. for 1.75 hour. The mixture is held at 260° C.–270° C. for 7.5 hour: total of 27 parts material collected in trap. Filter at 125° C.

EXAMPLE (b-1)-9

The procedure of Example (b-1)-1 is repeated replacing (THAM) with an equivalent amount, based on —OH of dibutylaminoethanol.

(b-2) The Acylated Derivative of (b-1)

In another embodiment, the amine (b) is the reaction product of any of the aforementioned polyamine products (b-1) with a carboxylic acid or anhydride wherein the resulting product contains at least one condensable N—H group. Such a material may be obtained by employing a stoichiometric excess of amine reactant relative to the carboxylic reactant.

The acylated derivative (b-2) includes the reaction product of mono- and polycarboxylic acids and functional derivatives thereof, such as anhydrides, with at least one polyamine (b-1), preferably an alkylene polyamine, as defined hereinabove, containing at least two condensable —N—H groups provided that the resulting product contains at least one condensable N—H group.

Suitable acylating agents are mono- and poly-carboxylic compounds, the same as those described hereinafter with reference to (c).

The reaction product of amine and carboxylic reactant itself may be reacted with a wide variety of other reactants. Exemplary reagents include carbon disulfide, $H_2S$, boron containing reagents such as boric acid, boron anhydride, boron esters, and the like, sulfur, sulfur chloride, alkenyl cyanides, carboxylic acid acylating agents, aldehydes, ketones, urea, thiourea, guanidine, dicyanodiamide, hydrocarbyl phosphates, hydrocarbyl phosphites, hydrocarbyl thiophosphates, hydrocarbyl thiophosphites, phosphorus sulfides, phosphorus oxides, phosphoric acid, hydrocarbyl thiocyanates, hydrocarbyl isocyanates, hydrocarbyl isothiocyanates, epoxides, episulfides, formaldehyde or formaldehyde producing compounds plus phenols. Boron containing agents are preferred and especially preferred are inorganic borating agents, boric acid being especially preferred.

The acylated amine (b-2) can be prepared by reacting any of the carboxylic acid acylating agents referred to herein with one or more of the polyamine products (b-1). Procedures for preparing acylated amines are well known in the art and are taught in many patents including U.S. Pat. Nos., 3,172,892; 3,219,666; 3,272,746; 4,234,435; and many others. In a typical process, the amine is heated with the acylating agent, optionally in the presence of a substantially inert, normally liquid organic diluent at temperatures ranging from about 30° C. up to the decomposition temperature of any reactant or product of reaction, more often from about 80° C. up to about 250° C. Relative proportions of amine and acylating agent are chosen such that (b-2) will contain at least one N—H group. Accordingly, a stoichiometric excess of (b-1) is usually employed relative to the acylating agent. The acylated amine product (b-2) is typically an amide, imide or amidine. Accordingly, sufficient (b-1) is used to generate the desired acylated amine which contains unreacted N—H groups. Post treated products are prepared by any of the procedures describe in the art, for example in U.S. Pat. No. 4,234,435.

Examples of reaction products useful as component b-2 include:

EXAMPLE (b-2)-1

A reactor is charged with 400 parts mineral oil and 1000 parts of a $N_2$ blown polyisobutenyl ($\overline{M}_n$=1000) succinic anhydride while mixing under an $N_2$ purge. The temperature is adjusted to 88° C. followed by addition of 152 parts of the product of Example (b-1)-1 while maintaining 88–93° C. The batch is mixed for 2 hours at 82–96° C., then the temperature is increased to 152° C. over 5.5 hours. At 152° C. the $N_2$ purge is discontinued and submerged $N_2$ is begun. The batch is heated at 149–154° C. until % $H_2O$ is no more than 0.30% by weight. The materials are cooled and filtered at 138–149° C. and adjusted with oil to give total oil of about 40% by weight. The product contains 2.15% N.

EXAMPLE (b-2)-2

The procedure of Example (b-2)-1 is followed employing 1000 parts of the $N_2$ blown succinic anhydride, 720 parts mineral oil and 111.3 parts of the product of Example (b-1)-1. The product contains 1.65% N.

EXAMPLE (b-2)-3

The procedure of example (b-2)-1 is repeated except that before filtration, the materials are reacted with 28 parts of terephthalic acid at 160° for three hours.

EXAMPLE (b-2)-4

The procedure of Example (b-2)-1 is repeated except that before filtration the materials are reacted with 21 parts $CS_2$ to give a sulfur and nitrogen containing condensate.

EXAMPLE (b-2)-5

A polybutene having a number average molecular weight=1350 (1000 parts) is reacted with 106 parts maleic anhydride with $Cl_2$ blowing (total $Cl_2$ about 90 parts) to prepare a substituted succinic anhydride. To a reactor containing 1000 parts of the substituted succinic anhydride are added 1050 parts mineral oil, the materials are heated, with mixing, to 120° C., then 70 parts of the product of Example (b-1)-1 are added. The reaction mixture is heated to 155° C. over 4 hours with $N_2$ sparging to remove volatiles then filtered employing a diatomaceous earth filter aid.

EXAMPLE (b-2)-6

An acylated polyamine is prepared by reacting 1000 parts of polyisobutenyl ($M_n$=1000) substituted succinic anhydride with 85 parts of the product of Example (b-1)-1 in 820 parts mineral oil diluent under conditions described in Example (b-2)-1.

EXAMPLE (b-2)-7

A boron containing composition is prepared by reacting a mixture of 275 parts mineral oil, 147 parts of the product of Example (b-1)-1 and 1000 parts of polyisobutene ($\overline{M}_n$≈1000) substituted succinic anhydride at 120–125° C. for 2 hours, at 150° C. for 2 hours, then blowing with nitrogen at 150° C. for 5 hours to form an acylated amine. To a slurry of 239 parts boric acid in 398 parts mineral oil there are added 1405 parts of above acylated amine over a period of 2 hours. The mixture is heated to 150° C. for 7 hours and filtered employing a diatomaceous earth filter aid to give a liquid product containing B and N.

EXAMPLE (b-2)-8

A solution of 698 parts mineral oil and 108 parts of the ethylene polyamine of Example (b-1)-1 is prepared and heated to 115° C. To the oil solution is added 1000 parts of the polybutenyl-substituted succinic anhydride of Example (b-1)-3 under $N_2$ followed by heating to 150° C. The reaction is continued at 143–150° C. for 1 hour. The product is then filtered.

EXAMPLE (b-2)-9

The procedure of Example (b-2)-4 is repeated except the polybutenyl group on the substituted succinic anhydride is derived from a polyisobutene having a number average molecular weight, measured by vapor phase osmometry, of about 1700.

EXAMPLE (b-2)-10

The procedure of Example (b-2)-1 is repeated except the reaction mixture includes 0.1 equivalent of polyether carboxylic acid sold under the tradename Neodox (Shell Chemical) per each C═O of succinic anhydride reactant.

EXAMPLE (b-2)-11

The procedure of Example (b-1)-1 is repeated replacing the product of Example (b-1)-1 with an equivalent amount, based on equivalents of N, of the product of Example (b-1)-9.

(c) The Hydrocarbyl Substituted Carboxylic Acid or Anhydride

Optionally, the compositions of this invention are prepared employing an additional reactant (c), a carboxylic acid or anhydride. Reactant c is most often used as a solubilizing agent when the amine reactant (b) is (b-1). Suitable carboxylic acids or anhydrides are hydrocarbyl substituted, aromatic, cycloaliphatic and aliphatic, preferably oil-soluble, mono- or poly-carboxylic acids. Polycarboxylic acids are defined herein as having 2 or more carboxyl groups. In one embodiment, the carboxylic acylating agent is characterized by the presence within its structure of from about 0.8 to about 2 succinic groups per hydrocarbyl substituent. Preferably the hydrocarbyl substituent is aliphatic and contains at least 8 carbon atoms, more preferably at least about 30 carbon atoms, up to about 200, more preferably, up to about 100 carbon atoms. In another embodiment (c) comprises a mixture of hydrocarbyl substituted carboxylic acids or anhydrides wherein the mixture comprises aliphatic substituted carboxylic acids or anhydrides containing from about 12 to about 24 carbon atoms in the aliphatic substituent and aliphatic substituted carboxylic acids or anhydrides having at least about 40 carbon atoms in the aliphatic substituent. In another preferred embodiment, the acid or anhydride (c) may contain from about 8 to 28 carbon atoms. When these are aliphatic acids, preferably predominantly linear acids, they tend to provide friction reducing characteristics to lubricating oils comprising the dispersant-viscosity improvers of this invention which incorporate such acids therein.

Useful acids may be illustrated by the general formula $$R—(COOH)_n \quad (II)$$

and the corresponding anhydrides, ester acids, or lactone acids thereof, wherein R is a hydrocarbyl group. R may be aliphatic or aromatic, including alkyl, alkenyl, aralkyl and alkaryl, including mixtures of acids containing aliphatic and aromatic groups. Preferably R is an aliphatic group containing from about 5 to about 500 carbon atoms, more preferably from 16 to about 200 carbon atoms, even more preferably from about 30 to about 100 carbon atoms. The subscript 'n' is a number ranging from 2 to about 10, preferably 2 to about 4, more preferably 2 or 3, especially 2. Preferred carboxylic acids include polyolefin substituted succinic acids, succinic anhydrides, ester acids or lactone acids. Mixtures of such acids are also useful.

Patents describing useful aliphatic polycarboxylic acids or anhydrides and methods for preparing them include, among numerous others, U.S. Pat. No. 3,215,707 (Rense); U.S. Pat. No. 3,219,666 (Norman et al), U.S. Pat. No. 3,231,587 (Rense); 3,912,764 (Palmer); U.S. Pat. No. 4,110,349 (Cohen); and U.S. Pat. No. 4,234,435 (Meinhardt et al); and U.K 1,440,219 which are hereby incorporated by reference for their disclosure of useful carboxylic reactants.

As indicated in the above-mentioned patents, which are hereby incorporated by reference for their disclosure of compounds useful as component (c) of his invention, the carboxylic acids (or various derivatives thereof) include those derived by the reaction of an alpha, beta-unsaturated carboxylic acid containing compound with a polyalkene or halogenated derivative thereof or a suitable olefin.

The polyalkenes from which the carboxylic acids reactants may be derived are homopolymers and interpolymers, also referred to herein as copolymers, of polymerizable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, "interpolymer (s)", or "copolymers" as used herein is inclusive of polymers derived from two different monomers, terpolymers, tetrapolymers, and the like. As will be apparent to those of ordinary skill in the art, the polyalkenes from which the substituent groups are derived are often conventionally referred to as "polyolefin(s)".

The olefin monomers from which the polyalkenes are derived are polymerizable olefin monomers characterized by the presence of one or more ethylenically unsaturated groups (i.e., >C═C<); that is, they are monolefinic monomers such as ethylene, propylene, 1-butene, isobutene, and 1-octene or polyolefinic monomers (usually diolefinic monomers) such as 1,3-butadiene and isoprene.

These olefin monomers are usually polymerizable terminal olefins; that is, olefins characterized by the presence in their structure of the group $>C{=}CH_2$. However, polymerizable internal olefin monomers (sometimes referred to in the literature as medial olefins) characterized by the presence within their structure of the group $$—C—C{=}C—C—$$

can also be used to form the polyalkenes. When internal olefin monomers are employed, they normally will be employed with terminal olefins to produce polyalkenes which are interpolymers. For purposes of this invention, when a particular polymerized olefin monomer can be classified as both a terminal olefin and an internal olefin, it will be deemed to be a terminal olefin. Thus, 1,3-pentadiene (i.e., piperylene) is deemed to be a terminal olefin for purposes of this invention.

Numerous polycarboxylic acids are commercially available, many from more than one source. The commercially available polycarboxylic acids can be used in the preparation of the compositions of this invention. While these commercially available polyacids, or derivatives thereof may be used by themselves, it is usually beneficial to employ them in combination with polyolefin substituted succinic acids, anhydrides or functional derivatives thereof. Such commercially available polycarboxylic acids and anhydrides include, but are not limited to aliphatic acids such as glutaric, adipic, sebacic, azaleic, dodecanedioic, 5-norbornene dicarboxylic, bicyclooctene dicarboxylic, 2-OH-succinic, citric, tartaric, cyclopentane tetracarboxylic, 5-norbornene-2,3-dicarboxylic, cyclohexene-4,5-dicarboxylic and cyclohexane dicarboxylic (1,2- 1,3-, and 1,4-). Also useful are aromatic acids and anhydrides such as phthalic, terephthalic, trimellitic anhydride , trimesic, pyromellitic, 2,3-naphthalenedicarboxylic, 1,8-naphthalic, benzophenone tetracarboxylic, and 1,1,3-trimethyl-3-phenylindane-4',5'-dicarboxylic.

Polycarboxylic acids from vegetable- and animal-sourced carboxylic compounds can be used for preparing polyesters of this invention. Dimer acids, made by the thermal coupling of unsaturated vegetable acids, are available from Emery, Westvaco, Unichema and other companies. Polyacid reaction products of unsaturated vegetable acids with acrylic acid and maleic anhydride are available from Westvaco under the product names Diacid 1550 and Tenax 2010, respectively. Another useful vegetable derived acid is 12-hydroxystearic acid, which can provide both carboxyl and hydroxy functionality to the polyester.

Additionally, polyether alpha, omega-acids, such as 3,6,9-trioxaundecane-1,11-dioic acid and mixed polyether diacids available from Hoechst Chemie can also be incorporated into the hydroxy-containing polyesters to impart surface activity and polarity, and to affect morphology at low temperatures.

Monocarboxylic acids have the formula RCOOH. R is a hydrocarbyl group, preferably an aliphatic group. Preferably, R contains from about 2 to about 500 carbon atoms. In one preferred embodiment, R is an aliphatic group containing from about 8 to about 24 carbon atoms more often from about 12 to about 18 carbon atoms. Examples of such acids are caprylic, capric, palmitic, stearic, isostearic, oleic, linoleic, and behenic acids.

A particularly preferred group of monocarboxylic acids is prepared by the reaction of a polyolefin or a halogenated olefin polymer with acrylic acid or methacrylic acid.

The above-described classes of carboxylic acids derived from olefin polymers, and their derivatives, are well known in the art, and methods for their preparation as well as representative examples of the types useful in the present invention are described in detail in the following U.S. patents:

| | | |
|---|---|---|
| 3,172,892 | 3,316,771 | 3,522,179 |
| 3,216,936 | 3,373,111 | 3,542,678 |
| 3,219,666 | 3,381,022 | 3,542,680 |
| 3,271,310 | 3,341,542 | 3,579,450 |
| 3,272,746 | 3,344,170 | 3,632,510 |
| 3,278,550 | 3,448,048 | 3,632,511 |
| 3,281,428 | 3,454,607 | 3,639,242 |
| 3,306,908 | 3,515,669 | |

Other useful acids include hydrocarbyloxy (polyalkyleneoxy)carboxylic acids. Some examples of the hydrocarbyloxypolyalkyleneoxycarboxylic acids include: isostearyl-O—$(CH_2CH_2O)_5CH_2CO_2H$; lauryl-O—$(CH_2CH_2O)_{2.5}$—$CH_2CO_2H$; lauryl-O—$(C_3H_6O)_x(CH_2CH_2O)_yCH_2CO_2H$, wherein x=2–3 and y=1–2, octylphenyl-O—$(CH_2CH_2O)_8CH_2CO_2H$; and 2-octadecanyl-O—$(CH_2CH_2O)_6CH_2CO_2H$. In one embodiment, the hydrocarbyloxypolyalkyleneoxycarboxylic acid is stearyl, preferably isostearyl, pentaethyleneglycolacetic acid. Some of these acids are available commercially from Sandoz Chemical under the tradename Sandopan® Acids and from Shell Chemical Co. under the tradename Neodox® carboxylic acids. Similar polyoxyalkylene carboxylic acids that have methoxy terminal groups, such as 3,6,9-trioxa-decanoic acid are marketed by Hoechst Chemie.

Other acids useful as (c) are aromatic acids such as benzoic, salicylic, hydroxynaphthoic and heterocyclic acids, for example, pyridine dicarboxylic acid.

Non-limiting examples of carboxylic compounds (c) include those in the following examples. Parts in the following examples are, unless otherwise indicated, parts by weight. Temperatures are in degrees Celsius (° C.). Filtrations employ a diatomaceous earth filter aid.

EXAMPLE c-a

A mixture of 6400 parts (4 moles) of a polybutene comprising predominantly isobutene units and having a number average molecular weight of about 1600 and 408 parts (4.16 moles) of maleic anhydride is heated at 225–240° C. for 4 hours. It is then cooled to 170° C. and an additional 102 parts (1.04 moles) of maleic anhydride is added, followed by 70 parts (0.99 mole) of chlorine; the latter is added over 3 hours at 170–215° C. The mixture is heated for an additional 3 hours at 215° C. then vacuum stripped at 220° C. and filtered through diatomaceous earth. The product is the desired polybutenyl-substituted succinic anhydride having a saponification number of 61.8.

EXAMPLE c-b

A polybutenyl succinic anhydride is prepared by the reaction of a chlorinated polybutylene with maleic anhydride at 200° C. The polybutenyl radical has a number average molecular weight of 805 and contains primarily isobutene units. The resulting alkenyl succinic anhydride is found to have an acid number of 113 (corresponding to an equivalent weight of 500).

EXAMPLE c-c

A lactone acid is prepared by reacting 2 equivalents of a polyolefin ($\overline{M}_n$ about 900) substituted succinic anhydride with 1.02 equivalents of water at a temperature of about 90° C. in the presence of a catalytic amount of concentrated sulfuric acid. Following completion of the reaction, the sulfuric acid catalyst is neutralized with sodium carbonate and the reaction mixture is filtered.

EXAMPLE c-d

An ester acid is prepared by reacting 2 equivalents of an alkyl substituted succinic anhydride having an average of about 35 carbon atoms in the alkyl group with 1 mole of ethanol.

EXAMPLE c-e

A reactor is charged with 1000 parts of polybutene having a number average molecular weight determined by vapor phase osmometry of about 950 and which consists primarily of isobutene units, followed by the addition of 108 parts of maleic anhydride. The mixture is heated to 110° C. followed by the sub-surface addition of 100 parts $C_{12}$ over 6.5 hours at a temperature ranging from 110 to 188° C. The exothermic reaction is controlled as not to exceed 188° C. The batch is blown with nitrogen then stored.

EXAMPLE c-f

A procedure similar to that of Example c-e is repeated employing 1000 parts of polybutene having a molecular weight determined by vapor phase osmometry of about 1650 and consisting primarily of isobutene units and 106 parts maleic anhydride. $Cl_2$ is added beginning at 130° C. and added at a nearly continuous rate such that the maximum temperature of 188° C. is reached near the end of chlorination. The residue is blown with nitrogen and collected.

EXAMPLE c-g

A reactor is charged with 1000 parts Of $C_{18-24}$ olefin mixture obtained from Albamarle Corporation, Houston, Tex. The material is heated to 65° followed by addition of 350 parts maleic anhydride. The temperature is increased to 213° then held at reflux until the total acid number is between 285–295. The reactor contents are stripped to remove volatile materials until analysis shows % maleic acid is less than 0.30%

EXAMPLE c-h

A reactor is charged with 1000 parts of a polybutene having a number average molecular weight of about 1500 and 47.9 parts molten maleic anhydride. The materials are heated to 138° C. followed by chlorination, allowing the temperature to rise to between 188–191° C., heating and chlorinating until the acid number is between 43 and 49 (about 40–45 parts $Cl_2$ are utilized). The materials are heated at 224–227° C. for about 2.5 hours until the acid number stabilizes. The reaction product is diluted with 438 parts mineral oil diluent and filtered with a diatomaceous earth filter aid.

When (c) is present, the dispersant-viscosity improvers of this invention may be prepared in several different ways. In one embodiment, all of (a), (b), and (c) are present at the outset. In another embodiment, (a) and (b) are reacted first followed by reaction with (c), and in yet another, (b) and (c) are reacted followed by (a).

(d) The Hydroxy-Containing Polyester

The compositions of this invention may be prepared by including in the reaction mixture (d) at least one preformed polyester containing at least one condensable hydroxyl group. The use of (d) is optional.

The hydroxy-containing polyesters are carboxylic compounds which contain at least one condensable hydroxyl group. As defined herein, condensable refers to the group's availability for further reaction with for example, an acylating agent.

The polyester may be prepared by reacting a hydrocarbyl-substituted polycarboxylic acid or functional derivative thereof, such as an anhydride, with a polyol, or a mixture of polyols wherein the polyol is present in amounts such that the number of hydroxyl groups thereon exceeds the number required to react with all of the available carboxyl groups. Subsequent condensation is usually carried out at high temperatures with removal of volatiles. Thus, the resulting product is a polyester containing unreacted hydroxyl groups.

The polycarboxylic acid employed to prepare the polyesters (d) are those described hereinabove as reactant (c). Mixtures of such acids are also useful and are contemplated for use in preparing the hydroxy containing polyesters.

Preferred polycarboxylic acids include polyolefin substituted succinic acids, succinic anhydrides, ester acids or lactone acids.

The carboxylic acid may also comprise up to about 20 equivalent % of the carboxylic acid functionality as monocarboxylic acid, that is, acids where n=1. Such mixtures of acids preferably contain no more than about 10 equivalent % as monocarboxylic acid, more preferably, no more than about 5 equivalent %. Most preferred is where the polycarboxylic acid used to prepare the polyesters used in this invention is essentially free of monocarboxylic acids, that is containing no more than a minor, impurity amount, of monocarboxylic acid.

Monocarboxylic acids which may be present in a mixture with polycarboxylic acids are those described hereinabove as reactant (c).

The polyhydric alcohols useful in the preparation of the polyhydroxyl esters may contain up to about 8 hydroxyl groups, and may be linear or branched. The expressions "branched" or "linear" refer to the configuration of the hydrocarbon backbone of the polyhydric alcohol. The polyhydric alcohol will generally contain from two to about 28 carbons. For example, glycerol, containing 3 hydroxy groups is linear and pentaerythritol, with four hydroxyl groups, is branched. Neopentylene glycol, with 2 hydroxyl groups, is branched.

Specific examples of polyhydroxy compounds useful in the present invention include ethylene glycol, diethylene glycol, propylene glycol, glycerol, butanediols, 1,4-butenediols, pentaerythritol, dipentaerythritol, trimethylolpropane, sorbitol, hexaglycerol, etc, and mixtures of any of the above polyhydroxy compounds can be utilized. Preferred polyhydric alcohols are ethylene glycol, neopentylene glycol, glycerol and pentaerythritol.

The polyhydric alcohols used in the preparation of the polyesters also may include polyethers or partial fatty acid esters of polyols or polyether polyols. Useful partial fatty acid esters contain at least two free hydroxyl groups, glycerol monooleate is illustrative.

The polyhydroxy compounds used in the preparation of the polycarboxylic polyesters also may contain one or more nitrogen atoms. For example, the polyhydroxy compound may be an alkanol amine containing from 2 to 6 hydroxy groups.

The carboxylic esters are prepared by reacting, usually in the presence of an acid catalyst, at least one carboxylic acid with at least one polyhydroxy compound containing at least two hydroxy groups, or by transesterification of lower alkyl esters with polyhydroxy compounds. These procedures are well known in the art.

The following examples illustrate polyesters (d) and processes for preparing polyesters.

EXAMPLE (d)-1

A substantially hydrocarbon-substituted succinic anhydride is prepared by chlorinating a polybutene having a number average molecular weight of 1000 to a chlorine content of 4.5% and then heating the chlorinated polybutene with 1.2 molar proportions of maleic anhydride at a temperature of 150–220° C. A mixture of 874 grams (2 carbonyl equivalents) of this succinic anhydride and 104 grams (1 mole) of neopentylene glycol is maintained at 240–250° C./30 mm for 12 hours. The residue is a mixture of hydroxy containing polyester resulting from the esterification of one and both hydroxy groups of the glycol. Typical analyses are acid number of 10, a number average molecular weight of 5500 and an average of one free condensable —OH per polyester molecular weight.

EXAMPLE (d)-2

A mixture of 3225 parts (5.0 carbonyl equivalents) of the polybutene-substituted succinic acylating agent prepared in Example (d)-1 and 289 parts (8.5 equivalents based on —OH) of pentaerythritol is heated at 224–235° C. for 5.5 hours, with removal of volatiles by nitrogen blowing. Then 5204 parts mineral oil are added followed by mixing. The homogeneous mixture is filtered at 130° C. to yield an oil solution of the desired polyester product.

EXAMPLE (d)-3

A mixture of 1000 parts of polybutene having a number average molecular weight of about 1000 and 108 parts (1.1 moles) of maleic anhydride is heated to about 190° C. and 100 parts (1.43 moles) of chlorine are added beneath the surface over a period of about 4 hours while maintaining the temperature at about 185–190° C. The mixture is then blown with nitrogen at this temperature for several hours, and the residue is the desired polybutenyl-substituted succinic acylating agent.

A solution of 1000 parts of the above-prepared acylating agent is heated to about 150° C. with stirring, and 109 parts (3.2 equivalents) of pentaerythritol are added with stirring. The mixture is blown with nitrogen and heated to about 220° C. over a period of about 14 hours. The batch is then mixed with 872 parts of mineral oil and filtered using a diatomaceous earth filter aid. The filtrate is an oil solution of the desired carboxylic polyester typically having a number average molecular weight of about 5179.

EXAMPLE (d)-4

A reactor is charged with 1000 parts of a polybutenyl-substituted succinic acylating agent prepared as in Example (d)-3. At between 160–175° C. are added 121 parts of pentaerythritol. The materials are heated to 200° C. over 8 hours followed by nitrogen blowing at 204–210° C. for 8 hours. Water is removed and is collected. Upon completion of the reaction, the materials are diluted with 872 parts of mineral oil and the solution is filtered with a diatomaceous earth filter aid. Typical analyses are acid number=8. The polyester contains about 1.8 —OH groups per repeating unit.

EXAMPLE (d)-5

Following essentially the procedure of Example (d)-1, a tetrapropenyl-substituted acylating agent is prepared and converted to a pentaerythritol polyester.

EXAMPLE (d)-6

A reactor charged with 1000 parts of the $C_{18-24}$ substituted succinic anhydride of Example c-g and 289 parts of pentaerythritol is heated to 200° C. and is held at 200° C. to 235° C. for 5 hours, removing volatiles by $N_2$ blowing. The materials are diluted with 800 parts of mineral oil and filtered.

EXAMPLE (d)-7

A reactor is charged with 1000 parts of the product of Example c-f and 464 parts of mineral oil. The materials are heated to 140° C. under $N_2$, 110 parts pentaerythritol are added and the materials are heated to 210° C. over 6 hours while removing water employing a sub-surface $N_2$ sparge. At this point 750 parts oil are added and the batch is cooled to 150° C. and filtered.

The carboxylic polyester derivatives which are described above resulting from the reaction of an acylating agent with a polyhydroxy-containing compound such as polyol or aminopolyol may be further reacted with any of the hereinafter described amines, and particularly polyamines.

These polycarboxylic acid derivative compositions are known in the art, and the preparation of a number of these derivatives is described in, for example, U.S. Pat. Nos. 3,957,854 and 4,234,435 which are hereby expressly incorporated herein by reference. The following example illustrates the preparation of the esters wherein an alkanolamine or both an alcohol and an amine are reacted with the acylating agent.

EXAMPLE (d)-8

A reactor is charged with 1000 parts of a polybutenyl-substituted succinic anhydride prepared essentially as described in Example (d)-3, 109 parts pentaerythritol and 31 parts Polyglycol® 112-3, a polyether polyol obtained by reacting glycerol, propylene oxide and ethylene oxide, having a molecular weight ranging from about 4600 to about 5300. The mixture is heated to 210° C. over 6 hours employing a sub-surface $N_2$ sparge. The materials are cooled to 160° C. and a toluene solution of 19 parts of commercial ethylene polyamine having a % N of about 34 is added over 1 hours followed by heating and $N_2$ sparging at 160° C. for 3 hours. The product is diluted with 800 parts mineral oil and filtered using a diatomaceous earth filter aid.

EXAMPLE (d)-9

To the polyester of example (d)-3 are added 857 parts of mineral oil and 19.25 parts (.46 equivalent) of a commercial mixture of ethylene polyamines having an average of about 3 to 10 nitrogen atoms per molecule. The reaction mixture is further stripped of volatiles by heating at 205° C. with nitrogen blowing for 3 hours and filtered. The filtrate is an oil solution (45% 100 neutral mineral oil) of the desired amine-modified carboxylic polyester of about 2850 number average molecular weight which contains 0.35% nitrogen, total base number of 2 and total acid number of 4.

EXAMPLE (d)-10

A reactor equipped with a stirrer, condenser with Dean-Stark trap, thermocouple probe and $N_2$ inlet ($N_2$ at 0.5 standard cubic feet/hour (SCFH)) is charged with 1100 parts of a polybutenyl substituted succinic anhydride prepared according to the procedure of Example (d)-3, 146 parts triethanolamine and 125 parts toluene. The mixture is heated to 210° over 4 hours then stirring and heating is continued at this temperature for 26 hours, collecting a clear yellow distillate having pH 7–9 in the Dean-Stark trap. $N_2$ flow is increased to 1.5 SCFH and stirring is continued at temperature for 3 additional hours, cool to 105°, and charge 800 parts mineral oil. The materials are stirred at temperature for 0.5 hour, mixed with a diatomaceous earth filter aid and filtered. The filtrate contains, by analysis, 0.69% N and 0.18% —OH. Total acid no.=1.83; total base no.=22.9.

EXAMPLE (d)-11

A reactor is charged with 1000 parts of the polyester of Example (d)-7 and heated to 150° C. A solution of 15 parts of a commercial polyamine having about 34% nitrogen and total base number of 41 in 15 parts toluene is added over 0.5 hour. The materials are stirred for 2 hours at 160° C. with $N_2$ sparging, 550 parts mineral oil is added and the solution is filtered.

Other discussions and illustrations of suitable procedures are provided, for example, in LeSuer, U.S. Pat. Nos. 3,381,022 and 3,522,179 and Meinhardt et al, U.S. Pat. No. 4,234,435.

As discussed hereinabove, the compositions of the present invention are prepared by reacting (a) the grafted polymer with (b) the amine. Reactant (b) is present in amounts sufficient to react with at least about 50% of the acid functionality of the grafted copolymer, more often at least about 75% of the acid functionality, more preferably up to 100%, and even in excess, up to about 300%, more often up to 200%.

Reactant (c) is often employed, if necessary, to improve solubility of the product when reactant (b) is (b-1).

The grafted copolymer (a) and the amine (b) are reacted in ratios ranging from about 1 C═O in (a) to about 2 N up to about 1 C═O from (a) to about 12 N from (b), preferably 1 C═O to about 4 N up to about 1 C═O to about 9 N.

Reactant (d), when used, may be present at any stage of the formation of the dispersant-viscosity improver.

The reactions are generally conducted at elevated temperatures, usually at temperatures ranging from about 100° C. to about 300° C. or even higher, but below the decomposition temperature of any of the reactants or products. Typical temperatures are those given in the following examples.

The following examples are intended to illustrate several compositions of this invention as well as means for preparing same.

EXAMPLE 1

Part A

A reactor equipped with a stirrer, gas inlet, wide-mouth addition funnel, thermowell and condenser is charged with 5950 parts of hydrotreated 100 neutral paraffinic oil. The oil is heated, under nitrogen sweep at 190 cc/min to 160° C. At this temperature, 1050 parts of an ethylene-propylene copolymer (52% ethylene, 48% propylene, by weight) having $\overline{M}_w$ of 210,000 and $\overline{M}_w/\overline{M}_n$ of 1.8, is added as small pieces (about ½–⅜" cubes) over 3 hours. After 4 hours at 160° C. all polymer appears to have dissolved, but the mixture is stirred 16 hours more at 160° C.

Part B

The solution is cooled to 130° C., nitrogen flow is reduced to 23–47 cc/min. and 15.3 parts maleic anhydride is charged followed by stirring for 0.25 hours. A solution of 15.3 parts of tertiary butyl peroxybenzoate in 20 parts of toluene is added dropwise over one hour followed by mixing 3 hours at 130–135° C. The temperature is increased to 160° C. and the reaction mixture is nitrogen stripped at 943 cc/min. for 4 hours to remove toluene and residual maleic anhydride. Saponification number=1.7; viscosity (100° C.)=7258 centistokes.

Part C

A reactor equipped with stirrer, gas inlet, addition funnel, thermowell, Dean-Stark trap, and condenser is charged with 2500 parts of the product of Example 1-B and 1750 parts mineral oil (Shell HVI 100N) and heated, with stirring and $N_2$ sparging, to 125° C., at which time 750 parts of the product of Example (b-2)-1 are added over 0.1 hour followed by heating to 150° C. over 0.5 hour. The $N_2$ flow is increased and the materials are heated for 3 hours at 150° C. to 160° C. The materials are cooled to 100° C. and filtered. Filtrate contains 0.36% N, total acid no=1.13 and total base no =5.2.

EXAMPLE 2

Part A

A reactor equipped with a stirrer, thermometer, water-cooled condenser and gas inlet is charged with 6912 parts of mineral oil (100 Neutral, Sun Oil). A nitrogen purge is begun and is maintained throughout the process. Hydrogenated styrene-isoprene copolymer having a molecular weight measured by gel permeation chromatography of about 180,000 (Shellvis 40, Shell Chemical Company), 768 parts, is added over 0.5 hours. The temperature is increased to 157° C. and is maintained at 157–160° C. for 3 hours, until the polymer is completely dissolved.

Part B

To the oil solution of Part A of this Example are added 19.2 parts of maleic anhydride, the materials are stirred for 0.25 hour then 19.2 parts ditertiary butyl peroxide are added over 1 hour. The materials are held at 159° C. for 1 hour, then the temperature is increased to 163° C. and the $N_2$ flow is increased. The reaction is held at 163°–166° C. for 3 hours, collecting a small amount of distillate. $N_2$ flow is decreased and 1920 parts diphenylalkane are added. The temperature is maintained at 150° C. for 0.5 hour.

Part C

A reactor is charged with 250 parts of the product of Part B of this example, and is heated to 100° C. with $N_2$ purge. To this solution are added 88 parts of the product of Example (b-2)-2 and the materials are heated to 160° C., maintaining $N_2$ purge, then maintained at 160° C. for 2 hours. The materials are the product.

EXAMPLE 3

Part A

Following substantially the procedure of Parts A and B of Example 2, 1361 parts of Shellvis 40 are dissolved in 12247 parts of mineral oil followed by reaction of 68.1 parts maleic anhydride in the presence of 68.1 parts of tertiary butyl peroxide. The material are further mixed with 3401 parts diphenyl alkane.

Part B

A reactor is charged with 1336 parts of the product of Part A of this example and 570 parts of the product of example (b-2)-2. Materials at 65° C. A nitrogen purge is maintained throughout the process. The materials are heated to 151° C. over 6 hours and are held at 151° C. for 1 hour. The materials are cooled to 93° C. and collected.

EXAMPLE 4

A reactor is charged with 1336 parts of the product of Example 3, Part A and 280 parts mineral oil, $N_2$ purging is begun, and the temperature is increased to 151° C. over 0.5 hour. The materials are held at 151° C. for 0.5 hour whereupon 401 parts of the product of Example (b-2)-2 are added, the temperature dropping to 140° C. The temperature is increased to 151° C. and is maintained at 150–155° C. for 2 hours, collecting about 0.5 parts distillate. The materials are cooled to 93° C. and collected.

EXAMPLE 5

Following substantially the procedure of Example 4, a product is obtained by reacting a solution of 1336 parts of the product of Example 3, Part A in 413 parts mineral oil with 267 parts of the product of Example (b-2)-2.

EXAMPLE 6

Following substantially the procedure of Example 4, a product is obtained by reacting a solution of 1336 parts of the product of Example 3, Part A in 546 parts mineral oil with 134 parts of the product of Example (b-2)-2.

EXAMPLE 7

Following substantially the procedure of Example 4, a product is obtained by reacting a solution of 1336 parts of the product of Example 3, Part A in 147 parts mineral oil with 534 parts of the product of Example (b-2)-1. Trace amounts of distillate are collected.

EXAMPLE 8

Following substantially the procedure of Example 4, a product is obtained by reacting a solution of 1336 parts of the product of Example 3, Part A in 280 parts mineral oil with 401 parts of the product of Example (b-2)-1. Trace amounts of distillate are collected.

EXAMPLE 9

Following substantially the procedure of Example 4, a product is obtained by reacting a solution of 750 parts of the product of Example 3, Part A in 232 parts mineral oil with 150 parts of the product of Example (b-2)-1. Trace amounts of distillate are collected.

EXAMPLE 10

Part A

A three liter flask equipped with a stirrer, reflux condenser, thermowell, and subsurface nitrogen sparging tube is charged with 1950 parts of 11.5 weight percent solution of Ortholeum 2052 a terpolymer containing about 48 weight percent ethylene units, 48 weight percent propylene units and 4 weight percent 1,4-hexadiene units, (E.I. DuPont DeNemours and Company) in 100 neutral solvent extracted diluent oil, containing additionally 3 weight percent of fumarate-vinyl acetate polymeric pour point depressant and 0.12 weight percent phenolic antioxidant. The solution is heated to 80° C. under a slow nitrogen sparge followed by addition of 21.8 parts of maleic anhydride. Stirring is continued while the reaction mixture is heated to 220° C. The mixture is held at this temperature for 8 hours, then blown with nitrogen at an increased rate to remove volatile materials. The solution is cooled to 150° C. and filtered using a diatomaceous earth filter aid yielding 1918 parts of viscous product having a total acid number (TAN) of 2.4.

Part B

Following the procedure of Example 4, a solution of 1000 parts of the product of Part A of this example in 200 parts mineral oil is reacted with 300 parts of the product of Example (b-2)-1.

EXAMPLE 11

Part A

A solution of 150 parts Ortholeum 2052 and 850 parts of 100N hydrotreated paraffinic oil is prepared under 135° C. under a nitrogen atmosphere. The solution is cooled to 90° C., 5 parts of maleic anhydride is added and the solution is heated to 135° C. under a nitrogen atmosphere. The solution is held at that temperature while a solution of 2 parts tertiary-butyl peroxide in 10 parts xylene is added over a one hour period with rapid stirring. The solution is held at 135° C. for an additional 2 hours then slowly heated to 155° C. over the next hour. The solution is blown with nitrogen over one hour at 155° C. to remove volatile materials (none collected), then cooled to yield a polymer solution containing 15% active agent having a TAN of 2.0.

Part B

A reactor is charged with 700 parts of the product of part A of this example, 120 parts of 100 neutral (100N) mineral oil and 350 parts of the product of Example (b-2)-2. The materials are heated to 150° C. and are held there, under $N_2$, for 1 hour then filtered.

EXAMPLE 12

Part A

A reactor equipped with thermowell, condenser, stirrer and subsurface $N_2$ inlet is charged with 2420 parts mineral oil. Over 0.5 hours are added, with stirring, 427 parts of a copolymer containing, by analysis, ethylene a weight ratio of 57:43, containing 1.4% by weight units derived from dicyclopentadiene and propylene units in and having polydispersity ($\overline{M}_w/\overline{M}_n$=2.2. $N_2$ sparging is at 94 cc/min. The material are heated to 160° C. and held at 160° C. overnight to dissolve the polymer. To this solution are added 4.3 parts maleic anhydride. The materials are stirred to dissolve maleic anhydride and the condenser is washed with about 5 parts toluene. Over 1 hour, at 160° C. are added, dropwise, 4.3 parts t-butyl peroxide. The reaction is held at 160° C. for 2 hours the $N_2$ sparging is increased to 700 cc/min. for 3 additional hours to remove volatiles. The product contains about 15% weight polymer and has TAN of 1.8.

Part B

A reactor is charged with 1000 parts of the product of Part A of this example, 700 parts 100N oil, and 300 parts of the product of Example (b-2)-2. The materials are heated to 150° C. and are held there, under $N_2$, for 1 hour, then filtered.

EXAMPLE 13

Part A

A reactor equipped with a stirrer, condenser, thermowell and sub-surface $N_2$ inlet is charged with 6375 parts mineral oil, then with stirring, 1125 parts Ortholeum 2052 are added over 0.5 hour. $N_2$ sparging is at 94 cc/min. The materials are heated to 157° C. and held at 157–160° C. for 6 hours to dissolve the polymer. To the solution are added 11.5 parts maleic anhydride, stirring is continued until the maleic anhydride is dissolved, then, over 1 hour, 11.5 parts di-tertiary-butyl peroxide are added. The reaction is held at 157–160° C. for 1 hour, then $N_2$ is increased to 470 cc/min, removing volatiles at 163–166° C. The product contains about 15% weight polymer and TAN of 6.0.

Part B

A reactor is charged with 1000 parts of the product of Part A of this example, 200 parts 100N oil and 350 parts of the product of Example (b-2)-2. The materials are heated to 150° C. and are held there, under $N_2$, for 1 hour, then filtered.

EXAMPLE 14

Part A

Maleic acid modification of Ortholeum 2052 is carried out in a Brabender twin-screw extruder having three heated zones, 125° C., 150° C. and 170°, over the length of the feeding screws. The screw configurations are set for feeding, mastication (using a different thread pitch to increase back pressure on the reactants and slow extrusion at atmospheric pressure. The polymer (97.5 parts, is cut into small pieces and fed into the extruder at a constant screw rotation rate of 50 revolutions per minute (RPM) while separate solutions of 2 parts maleic anhydride in 10 parts warm toluene and 1 part di-tertiary butyl peroxide in 10 parts toluene are fed in simultaneously, dropwise over the same time. The masticated mixture passes through the heated zones and is slowly extruded as a thin thread which is passed through a cold water bath and is subsequently chopped into small pellets. The solid product has TAN=10.

Part B

A reactor is charged with 700 parts 100N oil and 100 parts of the product of Part A of this example. The materials are heated to 135° C. under $N_2$ and held at temperature until the mixture is homogeneous. The solution is cooled to 100° C. whereupon 200 parts of the product of Example (b-2)-2 are added, with stirring. The temperature is increased to 150° C. and held for 1 hour with good stirring and $N_2$ sparging. The materials are filtered.

EXAMPLE 15

Part A

A reactor is charged with 750 parts of the solution of Ortholeum 2052 of Example 13, the temperature is increased to 170° C., 2 parts acrylic acid are added dropwise over 0.25 hour followed by the dropwise addition of a solution of 2 parts ditertiary butyl peroxide in 10 parts toluene. The reaction is continued, under $N_2$ for 2 hours at 165–170° C. while volatiles are removed.

Part B

To a second reactor are charged 500 parts of the product of part A of this example and 300 parts of the product of Example (b-2)-2. The materials are heated, under $N_2$, for 1 hour.

EXAMPLE 16

A reactor is charged with 800 parts of the maleic anhydride grafted Ortholeum 2052 described in Example 13 and 200 parts of polyalphaolefin oil having viscosity at 100° C. of 4.5 centistokes. The solution is heated to 125° C. with stirring under a $N_2$ purge whereupon 200 parts of the product of Example (b-2)-1 are added rapidly. The temperature is increased to 150° C. and is held at temperature for 1 hour, followed by cooling to 120° C. and filtration.

EXAMPLE 17

Part A

A solution of 800 parts of hydrogenated styrene-butadiene random block copolymer (Glissoviscal 5260, supplied by BASF) in 4200 parts 100N oil (Sun Oil) is prepared by adding the solid polymer to the mineral oil in a 12-liter, 4-necked reaction flask equipped with a stirrer, thermometer, subsurface nitrogen purge tube, solids addition funnel and water cooled condenser, at 160° C. over 1.25 hours with stirring. The mixture is held at 160° C. for 2.75 hours to obtain solution of the solids. A slow, subsurface nitrogen sparge is maintained during the processing steps. The temperature is reduced to 130° C., 50 parts maleic anhydride are added followed by dropwise addition over 1.5 hours, of a solution of 20 parts ditertiary butyl peroxide in 100 parts toluene. The materials are reacted for 2 hours at 140° C. with $N_2$ sparging, removing volatile materials. To the residue are added 200 parts diphenyl alkane and the mixture is homogenized at 125° C.

Part B

A reactor is charged with 800 parts of the product of Part A of this example and 200 parts of the product of Example (b-2)-2 followed by heating, under $N_2$, to 150° C. The temperature is maintained at 150° C. for 1 hour then filtered.

EXAMPLE 18

A solution of 200 parts of a hydrogenated styrene-isoprene radial copolymer (Shellvis 250, Shell Chemical) in 1000 parts mineral oil is prepared. The temperature is adjusted to 135° C. whereupon 10 parts maleic anhydride are added followed by the dropwise addition over 1 hour of a solution of 2.5 parts ditertiarybutyl peroxide in 10 parts toluene. The reaction is continued for 2 hours at 140° C. using $N_2$ sparge to remove volatile materials. The product has theory TAN of 3.3.

Part B

A reactor is charged with 1000 parts of the maleinated polymer of Part A of this example and 200 parts of 100N oil, the temperature is adjusted to 100° C. under $N_2$, whereupon 300 parts of the product of Example (b-2)-2 are added followed by heating to 150° C. The temperature is maintained for 1.5 hours.

EXAMPLE 19

A solution of 150 parts 120,000 molecular weight polyisobutylene-polymer containing about 4% by weight diene monomer segments in 850 parts hydrotreated 100N oil is prepared as in Example 2. The temperature is adjusted to 90° C., 5 parts maleic anhydride are added and the temperature is increased to 135° C. under $N_2$. A solution of 2.5 parts ditertiarybutyl peroxide in 10 parts toluene is added over 1 hour, then the materials are heated for an additional 2 hours at 140° C.

Part B

A reactor is charged with 1000 parts of the product of Part A of this example and 200 parts 100N oil. The temperature is raised to 100° C. under $N_2$, 300 parts of the product of Example (b-2)-2 are added, the materials are heated to 150° C. and are held at temperature for 1.5 hours, removing volatiles with $N_2$ sparging.

EXAMPLE 20

Part A

A solution containing a mixture of 80 parts Shellvis 40 and 40 parts Ortholeum 2052 in 880 parts 100N paraffinic oil is prepared as in Example 2. The product is maleinated with 10 parts maleic anhydride using 5 parts tertiarybutyl peroxide as in Example 19.

Part B

A reactor is charged with 800 parts of the product of Part A of this example and 300 parts poly(alphaolefin) oil having viscosity of 4.5 centistokes at 100° C., the temperature is increased to 125° C. and 300 parts of the product of Example (b-2)-1 are charged followed by heating to 150° C. The materials are heated at 150° C. for 2 hour, removing volatiles with $N_2$ sparging the filtered.

EXAMPLE 21

Part A

A solution containing 96 parts Shellvis 40 and 24 parts BASF Glissoviscal CE5260 in 880 parts hydrotreated 100N oil is prepared as in Example 2. The polymer mixture is maleinated with 10 parts maleic anhydride using a solution of 5 parts ditertiary butyl peroxide in toluene as the initiator as in Example 19. The product has TAN 4.0.

Part B

A reactor is charged with 1000 parts of the product of part A of this example and 200 parts of diphenyl alkane having viscosity of 3.8 centistokes at 100° C. The temperature is increased to 125° C., 300 parts of the product of Example (b-2)-1 are charged, the temperature is increased to 155° C., and held at temperature for 1 hour, removing volatiles with $N_2$ sparging. The product has viscosity of 1085 centistokes at 100° C.

EXAMPLE 22

A reactor is charged with 250 parts of the maleinated ethylene-propylene copolymer of Example 1-B, 200 parts 100N oil, and 50 parts of a polyisobutene ($\overline{M}_n$=1000) substituted succinic anhydride. The materials are heated to 150° C. whereupon 7.6 parts of the polyamine product of Example (b-1)-1 are added, dropwise, over 1 hour. The materials are heated at 150° C. for 1 hour, and collected.

EXAMPLE 23

A reactor is charged with 1000 parts of the product of Example 2 and 50 parts of the product of Example (d)-1. The materials are mixed and heated for 1.5 hours at 140–160° C.

EXAMPLE 24

The procedure of Example 1, part C, is repeated replacing the product of Example (b-2)-1 with an equivalent amount, based on equivalents of N of the product of Example (b-2)-11.

The Oil of Lubricating Viscosity

The lubricating compositions and methods of this invention employ an oil of lubricating viscosity, including natural or synthetic lubricating oils and mixtures thereof. Mixture of mineral oil and synthetic oils, particularly polyalphaolefin oils and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins, etc. and mixtures thereof, alkylbenzenes, polyphenyl, (e.g., biphenyls, terphenyls, alkylated polyphenyls, etc.), alkylated diphenyl ethers and alkylated diphenyl sulfides and their derivatives, analogs and homologues thereof and the like.

Alkylene oxide polymers and interpolymers and derivatives thereof, and those where terminal hydroxyl groups have been modified by esterification, etherification, etc., constitute other classes of known synthetic lubricating oils that can be used.

Another suitable class of synthetic lubricating oils that can be used comprises the esters of dicarboxylic acids and those made from $C_5$ to $C_{12}$ monocarboxylic acids and polyols or polyol ethers.

Other synthetic lubricating oils include liquid esters of phosphorus-containing acids, polymeric tetrahydrofurans and the like, silicon-based oils such as the polyalkyl-, polyaryl-, polyalkoxy-, or polyaryloxy-siloxane oils and silicate oils.

Hydrotreated naphthenic oils are well known.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

Specific examples of the above-described oils of lubricating viscosity are given in Chamberlin III., U.S. Pat. No. 4,326,972 and European Patent Publication 107,282, both of which are hereby incorporated by reference for relevant disclosures contained therein.

A basic, brief description of lubricant base oils appears in an article by D. V. Brock, "Lubrication Engineering", Volume 43, pages 184–5, March, 1987, which article is expressly incorporated by reference for relevant disclosures contained therein.

Other Additives

As mentioned, the compositions of this invention may contain minor amounts of other components. The use of such additives is optional and the presence thereof in the compositions of this invention will depend on the particular use and level of performance required. The compositions may comprise a zinc salt of a dithiophosphoric acid. Zinc salts of dithiophosphoric acids are often referred to as zinc dithiophosphates, zinc O,O-dihydrocarbyl dithiophosphates, and other commonly used names. They are sometimes referred to by the abbreviation ZDP. One or more zinc salts of dithiophosphoric acids may be present in a minor amount to provide additional extreme pressure, anti-wear and antioxidancy performance.

In addition to zinc salts of dithiophosphoric acids discussed hereinabove, other additives that may optionally be used in the lubricating oils of this invention include, for example, detergents, dispersants, viscosity improvers, oxidation inhibiting agents, metal passivating agents, pour point depressing agents, extreme pressure agents, anti-wear agents, color stabilizers and anti-foam agents. The above-mentioned dispersants and viscosity improvers are used in addition to the additives of this invention.

Auxiliary extreme pressure agents and corrosion and oxidation inhibiting agents which may be included in the compositions of the invention are exemplified by chlorinated aliphatic hydrocarbons, organic sulfides and polysulfides, phosphorus esters including dihydrocarbon and trihydrocarbon phosphites, molybdenum compounds, and the like.

Auxiliary viscosity improvers (also sometimes referred to as viscosity index improvers) may be included in the compositions of this invention. Viscosity improvers are usually polymers, including polyisobutenes, polymethacrylic acid esters, diene polymers, polyalkyl styrenes, alkenylarene-conjugated diene copolymers and polyolefins. Multifunctional viscosity improvers, other than those of the present invention, which also have dispersant and/or antioxidancy properties are known and may optionally be used in addition to the products of this invention. Such products are described in numerous publications including those mentioned in the Background of the Invention. Each of these publications is hereby expressly incorporated by reference.

Pour point depressants are a particularly useful type of additive often included in the lubricating oils described herein. See for example, page 8 of 'Lubricant Additives" by C. V. Smalheer and R. Kennedy Smith (Lezius-Hiles Company Publisher, Cleveland, Ohio, 1967). Pour point depressants useful for the purpose of this invention, techniques for their preparation and their use are described in U.S. Pat. Nos. 2,387,501; 2,015,748; 2,655,479; 1,815,022; 2,191,498; 2,666,748; 2,721,877; 2,721,878; and 3,250,715 which are expressly incorporated by reference for their relevant disclosures. Examples of pour point depressants are polyacrylates, alkylated naphthalenes, styrene/alkyl maleate and fumarate—and maleate ester/vinyl acetate copolymers.

Anti-foam agents used to reduce or prevent the formation of stable foam include silicones or organic polymers. Examples of these and additional anti-foam compositions are described in "Foam Control Agents", by Henry T. Kemer (Noyes Data Corporation, 1976), pages 125–162.

Detergents and dispersants may be of the ash-producing or ashless type. The ash-producing detergents are exemplified by oil soluble neutral and basic salts of alkali or alkaline earth metals with sulfonic acids, carboxylic acids, phenols or organic phosphorus acids characterized by at least one direct carbon-to-phosphorus linkage.

The term "basic salt" is used to designate metal salts wherein the metal is present in stoichiometrically larger amounts than the organic acid radical. Basic salts and techniques for preparing and using them are well known to those skilled in the art and need not be discussed in detail here. The basic salts contain an amount of metal greater than the stoichrometric amount based on equivalents of acid and base used to form the salt. The extent of "overbasing" is indicated by the term metal ratio (MR) which indicates the number of equivalents of base per equivalent of acid.

Ashless detergents and dispersants are so-called despite the fact that, depending on its constitution, the detergent or dispersant may upon combustion yield a nonvolatile residue such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in British Patent number 1,306,529 and in many U.S. patents including the following:

| | | |
|---|---|---|
| 3,163,603 | 3,381,022 | 3,542,680 |
| 3,184,474 | 3,399,141 | 3,567,637 |
| 3,215,707 | 3,415,750 | 3,574,101 |
| 3,219,666 | 3,433,744 | 3,576,743 |
| 3,271,310 | 3,444,170 | 3,630,904 |
| 3,272,746 | 3,448,048 | 3,632,510 |
| 3,281,357 | 3,448,049 | 3,632,511 |
| 3,306,908 | 3,451,933 | 3,697,428 |
| 3,311,558 | 3,454,607 | 3,725,441 |
| 3,316,177 | 3,467,668 | 4,194,886 |
| 3,340,281 | 3,501,405 | 4,234,435 |
| 3,341,542 | 3,522,179 | 4,491,527 |
| 3,346,493 | 3,541,012 | RE 26,433 |
| 3,351,552 | 3,541,678 | |

(2) Reaction products of relatively high molecular weight aliphatic or alicyclic halides with amines, preferably polyalkylene polyamines. These may be characterized as "amine dispersants" and examples thereof are described for example, in the following U.S. patents:

| | |
|---|---|
| 3,275,554 | 3,454,555 |
| 3,438,757 | 3,565,804 |

(3) Reaction products of alkyl phenols in which the alkyl groups contains at least about 30 carbon atoms with aldehydes (especially formaldehyde) and amines (especially polyalkylene polyamines), which may be characterized as "Mannich dispersants". The materials described in the following U.S. patents are illustrative:

| | |
|---|---|
| 3,413,347 | 3,725,480 |
| 3,697,574 | 3,726,882 |
| 3,725,277 | |

(4) Products obtained by post-treating the carboxylic amine or Mannich dispersants with such reagents are urea, thiourea, carbon disulfide, aldehydes, ketones, carboxylic acids, hydrocarbon-substituted succinic anhydrides, nitrites, epoxides, boron compounds, phosphorus compounds or the like. Exemplary materials of this kind are described in the following U.S. patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |
| | | | 4,234,435 |

(5) Interpolymers of oil-solubilizing monomers such as decyl methacrylate, vinyl decyl ether and high molecular weight olefins with monomers containing polar substituents, e.g., aminoalkyl acrylates or methacrylates, acrylamides and poly-(oxyethylene)-substituted acrylates. These may be characterized as "polymeric dispersants" and examples thereof are disclosed in the following U.S. patents:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

The above-illustrated additives may each be present in lubricating compositions at a concentration of as little as 0.001% by weight usually ranging from about 0.01% to about 20% by weight, more often from about 1% to about 12% by weight.

The compositions of the present invention are present in a minor amounts, often amounts ranging from about 1% to about 20% by weight, more often from about 3% to about 10% by weight, even more often from about 5% to about 8% by weight.

Additive Concentrates

The various additives described herein can be added directly to the lubricant. Preferably, however, they are diluted with a substantially inert, normally liquid organic diluent such as mineral oil, naphtha, benzene, toluene or xylene, to form an additive concentrate. These concentrates usually comprise about to about 60% by weight of the compositions of this invention, more often from 4% to 40%, and may contain, in addition, one or more other additives known in the art or described hereinabove. Concentrations such as 15%, 20%, 30% or 50% or higher may be employed.

Pour point depressants are frequently incorporated into additive concentrates of this invention, usually in amounts ranging from about 1% to about 10% by weight of the additive concentrate.

The lubricating compositions of this invention are illustrated by the examples in the following Tables. The lubricating compositions are prepared by combining the specified ingredients, individually or from concentrates, in the indicated amounts and oil of lubricating viscosity to make the total 100 parts by weight. The amounts shown are indicated as parts by weight or parts by volume. Unless indicated otherwise, where components are indicated as parts by weight, they are amounts of chemical present on an oil-free basis. Thus, for example, an additive comprising 50% oil used at 10% by weight in a blend, provides 5% by weight of chemical.

Where percentages of components are on a volume basis, the examples indicate the amounts of diluent (if any) present in the component as percent by weight diluent.

These examples are presented for illustrative purposes only, and are not intended to limit the scope of this invention.

TABLE I

| LUBRICANTS | | | | |
|---|---|---|---|---|
| Example | A | B | C | D |
| Base Oil | Exxon | Exxon | Exxon | Texaco |
| Grade | 15W-40 | 15W-40 | 10W-30 | 10W-40 |
| Component: (percent by weight) | | | | |
| Polybutene ($\overline{M}_n$ ~1300) subst. succinic anhydride-ethylene polyamine reaction product | 2.3 | 2.3 | 0.45 | 1.55 |
| Ca overbased MR ~1.1) S-coupled alkyl phenate | 0.9 | 0.9 | | |
| Ca overbased (MR ~3.5) S-coupled alkyl phenate | | | 0.27 | |
| Di-(nonyl phenyl) amine | 0.25 | 0.25 | 0.63 | 0.5 |
| Zinc salt of di-mixed isopropyl-methyl amyl dithiophosphate | | | 0.84 | |
| Ca overbased (MR ~1.2) alkyl benzene sulfonate | 0.5 | 0.5 | | 0.75 |
| Mg overbased (MR 14.7) alkyl benzene sulfonate | 0.4 | 0.4 | 0.34 | |
| Silicone antifoam | 0.007 | 0.007 | 0.009 | 0.009 |
| Product of Example 1-C | 7.7 | 8 | 13.0 | 8.7 |
| Zinc salt of di-mixed isopropyl-isoctyl dithiophosphate | 1.1 | 1.1 | | 0.62 |
| Ca overbased (MR ~2.3) S-coupled phenate) | 0.6 | 0.6 | | |
| Ca overbased (MR ~11) alkyl benzene sulfonate | | | 0.28 | 0.5 |
| Polybutene ($\overline{M}_n$ ~1000) substituted succinic anhydride-pentaerythritol/alkylene amine reaction product | 1.15 | 1.15 | | |
| t-Butyl-propylene tetramer substituted phenol | | | 0.3 | |
| Polymethacrylate Pour Point Depressant | 0.3 | 0.3 | 0.2 | 0.2 |
| Alkylphenoxypolyethoxy ethanol | | | | 0.1 |
| Zinc salt of di-mixed isopropyl-ethylhexyl dithiophosphate | | | | 1.17 |
| Polybutene ($\overline{M}_n$ ~1000) subst. succinic anhydride-ethylene polyamine reaction product | | | | 1.56 |
| $H_3BO_3$ post treated polybutene ($\overline{M}_n$ ~1000) subst. succinic anhydride-ethylene polyamine reaction product | | | | 0.54 |

EXAMPLES E–G

Lubricating oil compositions are prepared by blending into a 15SW-40 basestock (Unocal) 1.17% of a Zn salt of di-mixed isopropyl-2-ethylhexyl dithiophosphate, 0.25% of di(nonyl phenyl) amine, 0.54% Ca overbased (MR~2.3) sulfur coupled phenate, 0.75% Ca overbased (MR~1.2) alkyl benzene sulfonate, 0.24% Ca overbased (MR~11) alkyl benzene sulfonate, 0.29% Mg overbased (MR~14.7) alkyl benzene sulfonate, 100 ppm (parts per million parts lubricant) silicone antifoam agent, 8.5% of a product prepared essentially as described in Example 1-C and the additives listed in the following Examples:

EXAMPLE E 1.18% of boronated reaction product of polyisobutylene ($\overline{M}_n$~1300) substituted succinic anhydride with ethylene polyamines and 1.8% of boronated reaction product of polyisobutylene ($\overline{M}_n$~1000) substituted succinic anhydride with ethylene polyamines.

EXAMPLE F 1.25 parts of reaction product of polyisobutylene ($\overline{M}_n$~1300) substituted succinic anhydride with ethylene polyamines and 1.8% of reaction product of polyisobutylene ($\overline{M}_n$~1000) substituted succinic anhydride with ethylene polyamines.

EXAMPLE G 1.2% of boronated reaction product of polyisobutylene ($\overline{M}_n$~1300) substituted succinic anhydride with alkylene polyamine and 1.8% of reaction product of polyisobutylene ($\overline{M}_n$~1000) substituted succinic anhydride with ethylene polyamines.

EXAMPLE H

A lubricating oil composition as in Example C employing 11.5% of the product of Example 1-C.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A dispersant-viscosity improver composition for lubricating oil compositions comprising the reaction product of (a) a hydrocarbon polymer having a number average molecular weight between 20,000 and 500,000 grafted with an α,β-ethylenically unsaturated carboxylic acid or functional derivative thereof containing from 2 to about 20 carbon atoms exclusive of carbonyl carbons and present in the range of about 0.01 to about 10 percent by weight based on the weight of the polymer; and (b) an amine selected from the group consisting of (b-1) a polyamine product having at least one condensable primary or secondary amino group, made by contacting at least one hydroxy-containing material (b-i) having the general formula $$(R)_nY_z—X_p—A(OH)_q)_m \quad (I)$$

wherein each R is independently H or hydrocarbon based group, Y is selected from the group consisting of O, N, and S, X is a polyvalent hydrocarbon based group, A is a polyvalent hydrocarbon based group, n is 1 or 2, z is 0 or 1, p is 0 or 1, q ranges from 1 to about 10, and m is a number ranging from 1 to about 10; with (b-ii) at least one amine having at least one N—H group, and (b-2) an acylated derivative of (b-1) containing at least one condensable N—H group, and optionally, (c) at least one hydrocarbon group substituted carboxylic acid or anhydride.

2. The composition of claim 1 wherein the reaction product further comprises at least one preformed polyester containing at least one condensable hydroxyl group.

3. The composition of claim 1 wherein the hydrocarbon polymer is selected from the group consisting of (1) hydrogenated polymers of dienes;

(2) hydrogenated copolymers of a conjugated diene with one or more vinyl substituted aromatic compounds;

(3) polymers of alpha olefins containing from 2 to about 28 carbon atoms;

(4) olefin-diene copolymers; and (5) star polymers.

4. The composition of claim 3 wherein the hydrocarbon polymer is (1) a hydrogenated polymer of dienes, wherein the diene is a conjugated diene selected from the group consisting of isoprene, butadiene, and piperylene.

5. The composition of claim 3 wherein the hydrocarbon polymer is (2) a hydrogenated copolymer of a conjugated diene with a vinyl substituted aromatic compound wherein the vinyl substituted aromatic compound is a styrenic monomer.

6. The composition of claim 3 wherein the hydrocarbon polymer is (2) a hydrogenated copolymer of a conjugated diene with a vinyl substituted aromatic compound wherein the diene is selected from the group consisting of isoprene, butadiene, and piperylene.

7. The composition of claim 5 wherein the diene is selected from the group consisting of isoprene and 1,3-butadiene and the styrenic monomer is styrene.

8. The composition of claim 7 wherein the hydrocarbon polymer is a block copolymer.

9. The composition of claim 3 wherein the hydrocarbon polymer is (3) a copolymer of aliphatic olefins containing from 2 to about 28 carbon atoms wherein one olefin is ethylene.

10. The composition of claim 9 wherein the hydrocarbon polymer is an ethylene-propylene copolymer.

11. The composition of claim 3 wherein the hydrocarbon polymer is (4) an olefin-diene copolymer wherein the olefin comprises ethylene and propylene and the diene is a non-conjugated diene.

12. The composition of claim 3 wherein the hydrocarbon polymer is (4) an olefin-diene copolymer wherein the diene is a conjugated diene.

13. The composition of claim 11 wherein the diene is selected from the group consisting of 1,4-hexadiene, dicyclopentadiene, ethylidene norbornene, vinyl norbornene, and 4-vinyl cyclohexene.

14. The composition of claim 3 wherein the hydrocarbon polymer is (5) a star polymer wherein the arms are derived from dienes, wherein the diene moieties are substantially hydrogenated.

15. The composition of claim 14 wherein the star polymer comprises arms of polymers of dienes and vinyl substituted aromatic compounds.

16. The composition of claim 1 wherein the ethylenically unsaturated carboxylic acid or functional derivative thereof, comprises at least one member of the group consisting of maleic acid, maleic anhydride, fumaric acid, itaconic acid and itaconic anhydride and esters of the acids.

17. The composition of claim 1 wherein grafting of the hydrocarbon copolymer is conducted at about 80° C. to about 200° C. in the presence of a free radical initiator.

18. The composition of claim 1 wherein the amine is (b-1) the polyamine product and the grafted copolymer (a) is characterized by the presence of less than 2 moles of grafted carboxylic acid or functional derivative thereof per equivalent of hydrocarbon polymer.

19. The composition of claim 1 wherein the polyamine product (b-1) contains from about 0.1 to about 20% by weight of $H_2O$ and further contains from about 0.05 to about 1% by weight of phosphorus.

20. The composition of claim 1 wherein the hydroxy-containing material (b-i) contains from 1 to about 10 hydroxy groups.

21. The composition of claim 1 wherein the hydroxy-containing material (b-i) is selected from the group consisting of glycerol, polyglycerols, ethylene glycol, ethanolamine, diethanolamine, tris-(hydroxymethyl) aminomethane, 2-amino-2-methyl-1,3-propanediol, ethoxylated polyamines, and polyoxyalkylene glycols.

22. The composition of claim 1 wherein the amine (b-ii) is an alkylene polyamine.

23. The composition of claim 22 wherein the alkylene polyamine is selected from the group consisting of ethylene polyamines, ethylene polyamine bottoms, and polyoxyalkylene polyamines.

24. The composition of claim 21 wherein the hydroxy containing material (b-i) is tris-(hydroxymethyl) aminomethane.

25. The composition of claim 1 wherein the amine (b) is (b-2), the acylated derivative of (b-1) containing at least one condensable N—H group.

26. The composition of claim 25 wherein the polyamine product (b-1) contains from about 0.1 to about 20% by weight $H_2O$ and further contains from 0.05 to about 1% by weight of phosphorus.

27. The composition of claim 25 wherein (b-2) is the product obtained by reacting the polyamine product (b-1) with a carboxylic acid acylating agent.

28. The composition of claim 27 wherein the carboxylic acid acylating agent is a hydrocarbyl substituted succinic acid or anhydride.

29. The composition of claim 25 wherein the hydrocarbyl substituent is an aliphatic group containing from about 30 to about 200 carbon atoms.

30. The composition of claim 27 wherein the carboxylic acylating agent is characterized by the presence within its structure of from about 0.8 to about 2.0 succinic groups per hydrocarbyl substituent.

31. The composition of claim 27 wherein the carboxylic acid acylating agent is a monocarboxylic acid containing from about 8 to about 28 carbon atoms.

32. The composition of claim 1 wherein the reaction product further comprises boron.

33. An additive concentrate comprising an inert normally liquid organic diluent and from about 4 to about 40 percent by weight of the composition of claim 1.

34. A lubricating composition comprising a major amount of an oil of lubricating viscosity and a minor amount of the composition of claim 1.

35. The additive concentrate of claim 33 further comprising from about 1% to about 10% by weight of at least one pour point depressant selected from the group consisting of polyacrylates, alkylated naphthalenes, styrene/alkyl maleate, and fumarate- and maleate ester/vinyl acetate copolymers.

36. A lubricating composition comprising a major amount of an oil of lubricating viscosity and a minor amount of the additive concentrate of claim 33.

37. The lubricating composition of claim 34 wherein the oil of lubricating viscosity is a synthetic oil.

38. The lubricating composition of claim 34 wherein the oil of lubricating viscosity is a mineral oil.

39. The lubricating composition of claim 37 wherein the synthetic oil is a polyalphaolefin oil.

40. The lubricating composition of claim 38 wherein the mineral oil is a hydrotreated oil.

41. The lubricating composition of claim 34 wherein the oil of lubricating viscosity comprises a mixture of mineral oil and synthetic oil.

* * * * *